US007524041B2

(12) United States Patent
Sugahara

(10) Patent No.: US 7,524,041 B2
(45) Date of Patent: Apr. 28, 2009

(54) PRESSURE PRODUCING APPARATUS

(75) Inventor: Hiroto Sugahara, Aichi-ken (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 10/679,531

(22) Filed: Oct. 6, 2003

(65) Prior Publication Data

US 2004/0070650 A1 Apr. 15, 2004

(30) Foreign Application Priority Data

Oct. 15, 2002 (JP) ..... 2002-300762

(51) Int. Cl.
*B41J 2/045* (2006.01)

(52) U.S. Cl. ..... 347/71; 347/68

(58) Field of Classification Search ..... 310/324, 310/328, 330, 334, 366, 367–369; 347/68–72
See application file for complete search history.

(56) References Cited

U.S. PATENT DOCUMENTS

| | | | | |
|---|---|---|---|---|
| 4,350,916 | A * | 9/1982 | August et al. | 310/313 B |
| 4,586,512 | A * | 5/1986 | Do-huu et al. | 600/447 |
| 5,255,016 | A * | 10/1993 | Usui et al. | 347/71 |
| 5,592,042 | A * | 1/1997 | Takuchi et al. | 310/328 |
| 6,043,587 | A | 3/2000 | Jaenker | |
| 6,536,880 | B2 | 3/2003 | Takagi | |
| 6,610,427 | B2 | 8/2003 | Kashiwaya et al. | |
| 6,685,306 | B2 | 2/2004 | Sugahara | |
| 2002/0024567 | A1 | 2/2002 | Takagi | |
| 2002/0140787 | A1 * | 10/2002 | Takahashi | 347/72 |

FOREIGN PATENT DOCUMENTS

| | | |
|---|---|---|
| JP | 6-316070 | 11/1994 |
| JP | 9323410 | 12/1997 |
| JP | 10144974 | 5/1998 |
| JP | 11195820 | 7/1999 |
| JP | 2000025225 | 1/2000 |
| JP | 2002-59547 | 2/2002 |
| JP | 2002-127420 | 5/2002 |
| JP | 2002217465 | 8/2002 |
| JP | 2003008095 | 1/2003 |

* cited by examiner

*Primary Examiner*—Stephen D Meier
*Assistant Examiner*—Geoffrey Mruk
(74) *Attorney, Agent, or Firm*—Reed Smith LLP

(57) ABSTRACT

Cylindrical electrodes are embedded in a piezoelectric sheet of an actuator unit. An axial length of each of the electrodes is somewhat shorter than half a thickness of the piezoelectric sheet, and accordingly the electrodes do not penetrate through the sheet. The piezoelectric sheet is polarized in a surface direction parallel to a surface thereof. When the electrodes take a positive potential, an electric field is applied to the piezoelectric sheet in the surface direction, the actuator unit including the piezoelectric sheet is so curved as to swell upward, because there is produced a difference between respective amounts of extension in the surface direction of an upper portion of the sheet in which the electrodes are provided and a lower portion of the same in which no electrodes are provided.

32 Claims, 10 Drawing Sheets

RELATED ART

PRESSURE PRODUCING APPARATUS

BACKGROUND OF THE INVENTION

1. Field of the Invention

The present invention relates to a pressure producing apparatus that produces a pressure applied to a liquid, e.g., an ink accommodated in an ink chamber of an ink jet printer.

2. Discussion of Related Art

There is known a piezoelectric-type pressure producing mechanism or device that is used to apply a pressure to an ink accommodated in a pressure chamber of an ink jet printer head. Such a device is shown in, e.g., FIG. 11 of Japanese Patent Document No. 2002-59547 or its corresponding U.S. Patent Publication No. 2002024567, or FIG. 6 of Japanese Patent Document No. 2002-127420 or FIG. 9 of its corresponding U.S. Pat. No. 6,530,880. FIG. 10 of the present application shows a cross-sectional view of a conventional ink jet printer head 101 including, as an actuator unit 106 thereof, a piezoelectric-type pressure producing device. In the printer head 101 shown in FIG. 10, the actuator unit 106 is driven by a drive pulse signal that is produced by a drive circuit, not shown. The drive pulse signal selectively takes a ground potential or a certain positive potential. The actuator unit 106 is stacked on a supply-passage unit 107 that defines a supply passage through which the ink is supplied. The actuator unit 106 and the supply-passage unit 107 are adhered to each other using an epoxy-type thermosetting adhesive. The drive pulse signal produced by the drive circuit is supplied to the actuator unit 106 from a flexible wiring board, not shown, that is bonded to an upper surface of the actuator unit 106.

The supply-passage unit 107 includes three metallic thin sheets, i.e., a cavity sheet 107*a*, a spacer sheet 107*b*, and a manifold sheet 107*c*, and additionally includes a nozzle sheet 107*d* that has nozzles 109 each for outputting ink and is formed of a synthetic resin such as polyimide. The four sheets 107*a*-107*d* are stacked on each other, such that the uppermost cavity sheet 107*a* is in contact with the actuator unit 106.

The cavity sheet 107*a* has two arrays of pressure chambers 110, arranged in a lengthwise direction thereof, each of which accommodates ink that is outputted when the actuator unit 106 is operated. The pressure chambers 110 are isolated from each other by partition walls 110*a* and arranged such that respective lengthwise directions of the pressure chambers 110 are parallel to each other. The spacer sheet 107*b* has a first communication hole 111 that communicates one end of each pressure chamber 110 with the corresponding nozzle 109 and additionally has a second communication hole, not shown, that communicates the other end of the each pressure chamber 110 with a manifold passage, not shown.

The manifold sheet 107*c* has a third communication hole 113 that communicates the above-indicated one end of each pressure chamber 110 with the corresponding nozzle 109. The manifold sheet 107*c* additionally has the above-indicated manifold passage, not shown, that supplies ink to the each pressure chamber 110. The manifold passage extends, beneath each array of pressure chambers 110, in the direction of arrangement of those chambers 110. One end of the manifold passage is connected to an ink supplying source, not shown. Thus, the manifold passage, the second communication hole, the pressure chamber 110, the first communication hole 111, and the third communication hole 113 cooperate with each other to provide an ink supply passage that supplies ink to the nozzle 109.

The actuator unit 106 includes six piezoelectric ceramic sheets 106*a*, 106*b*, 106*c*, 106*d*, 106*e*, 106*f* that are formed of a ceramic material, i.e., lead zirconate titanate (PZT) and are stacked on each other. In only a limited portion of the actuator unit 106 that corresponds to each pressure chamber 110 of the supply-passage unit 107, a first common electrode 121 is interposed between two piezoelectric ceramic sheets 106*b*, 106*c*, and a second common electrode 123 is interposed between two piezoelectric ceramic sheets 106*d*, 106*e*. In addition, in the same limited portion of the actuator unit 106, a first individual electrode 122 is interposed between two piezoelectric ceramic sheets 106*c*, 106*d*, and a second individual electrode 124 is interposed between two piezoelectric ceramic sheets 106*e*, 106*f*.

The common electrodes 121, 123 are always kept at a ground potential, while the individual electrodes 122, 124 are supplied with the drive pulse signal. Respective portions of the three piezoelectric ceramic sheets 106*c*, 106*d*, 106*e* that are sandwiched by the four, common and individual electrodes 121, 123, 122, 124 cooperate with each other to provide an active portion 125 that is polarized, in advance, in the direction of stacking of the sheets 106*c*-106*e* when an electric field is applied thereto by the electrodes 121-124. Therefore, when the respective potentials of the two individual electrodes 122, 124 are changed to a certain positive potential, an electric field is applied to the active portion 125 of the piezoelectric ceramic sheets 106*c*-106*e*, so that the active portion 125 extends in the direction of stacking of the sheets 106*c*-106*e*. On the other hand, this phenomenon does not occur to the two piezoelectric ceramic sheets 106*a*, 106*b*. As a result, the active portion 125 of the actuator unit 106 swells out toward the pressure chamber 110. Thus, the volume of the pressure chamber 110 is decreased and accordingly a pressure is applied to the ink accommodated in the chamber 110, so that a droplet of ink is ejected from the nozzle 109.

FIG. 10 shows two pressure chambers 110. The left-hand pressure chamber 110 shows that a certain positive potential is applied to the two individual electrodes 122, 124, and the active portion 125 of the actuator unit 106 swells out toward the pressure chamber 110, so that the volume of the chamber 110 is decreased and accordingly a droplet of ink is ejected from the nozzle 109 communicating with the chamber 110. The right-hand pressure chamber 110 shows that the drive pulse signal is kept at the ground potential equal to the respective potentials of the common electrodes 121, 123, so that no ink is outputted from the nozzle 109 communicating with the chamber 110.

In addition, Japanese Patent Document No. 6-316070 shows, in FIGS. 1 and 2, an actuator unit of an ink jet printer head, i.e., a piezoelectric-type actuator unit having a so-called unimorph structure. This actuator unit includes a piezoelectric thin layer that is polarized in a direction of thickness thereof, and an electrically conductive coating layer and a flexible sheet that are bonded to the piezoelectric layer so as to sandwich the same. When an electric field is applied between the conductive coating layer and the flexible sheet, the piezoelectric layer swells out in the direction of thickness thereof and accordingly contracts in a direction parallel to a surface thereof. As a result, the piezoelectric layer swells out, with the flexible sheet, toward a pressure chamber. Subsequently, when the electric field is removed, the piezoelectric layer and the flexible sheet return to their initial, flat shape owing to their own elasticity. Thus, a droplet of ink is ejected from the pressure chamber.

All the actuator units disclosed by the above-identified three Japanese Patent Documents have a common feature that an electric field is applied to one or more piezoelectric elements in the direction of thickness thereof so as to deform the piezoelectric element or elements. Thus, it is required that the piezoelectric element or elements be sandwiched by the electrodes. However, complex steps are needed to manufacture an actuator unit having such structure, and accordingly the cost of manufacturing the same is increased.

In addition, the actuator unit disclosed by Japanese Patent Document No. 2002-59547 or Japanese Patent Document No. 2002-127420 has the structure that very thin piezoelectric sheets are stacked on each other. Therefore, if any of the piezoelectric sheets has fine cracks and accordingly ink leaks through the cracks, short circuit may occur between the two electrodes next to each other. This leads to lowering the durability of the actuator unit.

SUMMARY OF THE INVENTION

It is therefore an object of the present invention to provide a pressure producing apparatus that can enjoy a high degree of durability and/or can be manufactured in a simple method. This object may be achieved according to any one of the following modes of the present invention in the form of a pressure producing apparatus, each of which is numbered like the appended claims and may depend from the other mode or modes, where appropriate, to indicate and clarify possible combinations of technical features. It is, however, to be understood that the present invention is not limited to the technical features or any combinations thereof that will be described below for illustrative purposes only. It is to be further understood that a plurality of features included in any one of the following modes of the invention are not necessarily provided altogether, and that the invention may be embodied without employing at least one of the features described in connection with each of the modes.

(1) A pressure producing apparatus, comprising a sheet member which is formed of a piezoelectric material; at least one first electrode which is embedded in one of a first portion and a second portion of the sheet member, the first portion and the second portion being opposite to each other in a direction of thickness of the sheet member; and at least one second electrode which is embedded in the one of the first and second portions of the sheet member, such that the at least one second electrode is opposed to the at least one first electrode in a surface direction parallel to one of a first surface of the first portion and a second surface of the second portion, the first surface and the second surface being opposite to each other in the direction of thickness of the sheet member.

In the present pressure producing apparatus, the first and second electrodes do not penetrate through the thickness of the sheet member formed of the piezoelectric material. Therefore, if a potential difference is produced between the first and second electrodes, an electric field is applied, in the surface direction, to a portion of the sheet member that is located between the first and second electrodes, so that that portion (hereinafter, referred to as the "electrode area", if appropriate) is caused to deform owing to piezoelectric effect, i.e., elongate in the surface direction. On the other hand, no electric field is applied to a portion of the sheet member that is opposite to the electrode area in the direction of thickness of the sheet member and in which none of the first and second electrodes are provided, so that that portion (hereinafter, referred to as the "non-electrode area", if appropriate) resists the elongation of the electrode area in the surface direction. Consequently, the sheet member is deformed or curved in the direction of thickness thereof. Then, if the electric field is removed, the sheet member returns to its original shape owing to its own elasticity. Thus, the present apparatus can apply a pressure to a liquid.

The present pressure producing apparatus can be easily manufactured by a simple method in which the first and second electrodes are provided in the sheet member such that the first and second electrodes do not penetrate through the thickness of the sheet member. Therefore, the present apparatus can be produced at low cost.

(2) The pressure producing apparatus according to the mode (1), wherein the at least one first electrode and the at least one second electrode are embedded in the one of the first and second portions of the sheet member, such that the at least one first electrode and the at least one second electrode extend from the one of the first and second surfaces of the first and second portions of the sheet member in the direction of thickness thereof.

According to this mode, one of axially opposite end surfaces of each of the first and second electrodes is exposed in the one of the first and second surfaces of the sheet member, and accordingly the each electrode can be easily connected to an external electric circuit. However, this is not essentially required. Each of the first and second electrodes may be completely embedded in the one of the first and second portions of the sheet member.

(3) The pressure producing apparatus according to the mode (1), wherein a portion of the one of the first and second portions of the sheet member that is located between the at least one first electrode and the at least one second electrode is polarized in the surface direction in which the at least one first electrode and the at least one second electrode are opposed to each other, so as to provide an active portion, and wherein when an electric field is applied to the active portion of the sheet member in a same direction as the direction of polarization of the active portion, the sheet member is curved in the direction of thickness thereof because of a difference between an amount of elongation in the surface direction of the one of the first and second portions of the sheet member in which the at least one first electrode and the at least one second electrode are provided and an amount of elongation in the surface direction of the other of the first and second portions in which the at least one first electrode and the at least one second electrode are not provided.

According to this mode, the electrode area, i.e., active portion of the sheet member is elongated in the surface direction by the electric field applied in the same direction as the direction of polarization of the active portion, whereas the non-electrode area of the sheet member is not elongated in the surface direction. Consequently, the sheet member is curved in the direction of thickness thereof such that the active portion thereof swells out, and accordingly the pressure is applied to the liquid.

(4) The pressure producing apparatus according to the mode (1), comprising a plurality of the first electrodes and a plurality of the second electrodes, wherein the first and second electrodes are embedded in a limited portion of the one of the first and second portions of the sheet member that is limited in the surface direction.

According to this mode, as compared with the conventional pressure producing device in which piezoelectric sheet members and large-size electrodes are stacked on each other, the distance between the first and second electrodes and the surface area of each of the first and second electrodes can be reduced in the present pressure producing apparatus and accordingly a drive electric voltage and an electrostatic capacitance needed for the present apparatus can be reduced. Consequently, a driver IC and an electric circuit employed by the present apparatus can be produced at low cost and additionally the amount of consumption of energy and the amount of radiation of heat can be reduced in the present apparatus.

(5) The pressure producing apparatus according to the mode (1), comprising a plurality of groups of the first electrodes and a plurality of groups of the second electrodes, wherein the plurality of groups of first electrodes are arranged along a plurality of concentric first circles, respectively, and the plurality of groups of second electrodes are arranged along a plurality of concentric second circles, respectively, and wherein the first and second circles are concentric with each other and the groups of first electrodes and the groups of second electrodes are alternate with each other in a radial direction of the concentric first and second circles.

(6) The pressure producing apparatus according to the mode (1), comprising a plurality of groups of the first electrodes and a plurality of groups of the second electrodes, wherein the plurality of groups of first electrodes are arranged along a plurality of first lines, respectively, and the plurality of groups of second electrodes are arranged along a plurality of second lines, respectively, and wherein the groups of first electrodes and the groups of second electrodes are alternate with each other in a direction intersecting the first and second lines.

According to the mode (5) or (6), the amount of deformation of the sheet member can be increased.

(7) The pressure producing apparatus according to the mode (4), wherein the sheet member has, in the one of the first and second surfaces thereof that corresponds to the one of the first and second portions thereof, a plurality of recesses which cooperate with each other to at least partly surround the limited portion of the one of the first and second portions in which the first and second electrodes are provided.

According to this mode, the recesses can prevent the phenomenon of "cross-talk" that the deformation of one active portion influences that of another active portion.

(8) The pressure producing apparatus according to the mode (1), wherein the apparatus further comprises a liquid-chamber defining member which cooperates with the other of the first and second surfaces of the sheet member that does not correspond to the one of the first and second portions to define a liquid chamber in which a liquid is accommodated, and wherein the apparatus changes a pressure of the liquid accommodated in the liquid chamber.

According to this mode, when a shot of liquid is outputted in a "draw-and-shoot" method in which after a volume of the liquid chamber is increased from a normal or reference volume thereof, the increased volume is returned to the normal volume to output the shot of liquid, a large pressure can be applied to the liquid in a manner in which no electric field is applied to the sheet member in a normal or initial state thereof, subsequently an electric field is applied to the sheet member to increase the volume of the liquid chamber, and then the electric field is removed from the sheet member to decrease the increased volume to the normal volume. Consequently, the total time of application of electric field can be significantly reduced, and accordingly the amount of consumption of energy can be reduced and the degree of safety can be increased. Moreover, since the electrodes are located at respective positions away from the liquid, the present apparatus does not suffer a disorder that short circuit occurs between the electrodes because of leakage of the liquid, even if the sheet member may have fine cracks.

(9) The pressure producing apparatus according to the mode (8), comprising a plurality of groups of the first electrodes and a plurality of groups of the second electrodes, wherein the liquid-chamber defining member includes at least one partition wall which cooperates with the other of the first and second surfaces of the sheet member to define a plurality of liquid chambers in each of which the liquid is accommodated, wherein the plurality of groups of first electrodes and the plurality of groups of second electrodes are provided in a plurality of limited portions of the one of the first and second portions of the sheet member, respectively, that are aligned with the plurality of liquid chambers, respectively.

According to this mode, a pressure can be efficiently applied to the liquid accommodated in each of the plurality of liquid chambers.

(10) A pressure producing apparatus, comprising a first sheet member which is formed of a piezoelectric material; at least one first electrode which is embedded in the first sheet member; at least one second electrode which is embedded in the first sheet member such that the at least one second electrode is opposed to the at least one first electrode in a surface direction parallel to a first surface of the first sheet member; and a second sheet member which is stacked on the first sheet member and resists elongation of the first sheet member in the surface direction that occurs when an electric field is applied, in the surface direction, to a portion of the first sheet member that is located between the at least one first electrode and the at least one second electrode.

In the present pressure producing apparatus, the first and second electrodes are embedded in the first sheet member formed of the piezoelectric material, and are not embedded in the second sheet member. Therefore, if a potential difference is produced between the first and second electrodes, an electric field is applied, in the surface direction, to an electrode area of the first sheet member that is located between the first and second electrodes, so that the electrode area is deformed owing to piezoelectric effect, i.e., elongate in the surface direction. On the other hand, no electric field is applied to a non-electrode area of the first sheet member that is opposite to the electrode area in the direction of thickness of the first sheet member, and/or the second sheet member, where none of the first and second electrodes are provided, so that the non-electrode area and/or the second sheet member resists the elongation of the electrode area in the surface direction. Consequently, the first and second sheet members stacked on each other are deformed or curved in the directions of thickness thereof. Then, if the electric field is removed, the first and second sheet members return to their original shapes owing to their own elasticity. Thus, the present apparatus can apply a pressure to a liquid.

The present pressure producing apparatus can be easily manufactured by a simple method in which the first and second electrodes are provided in the first sheet member and the first and second sheet members are stacked on each other. Therefore, the present apparatus can be produced at low cost. As compared with the method of manufacturing the apparatus according to the mode (1), this method includes the additional step in which the two sheet members are stacked on each other. However, in view of a fact that the first sheet member may be worked to have not blind holes, but through-holes, for receiving the first and second electrodes, this method may be simplified to an advantage. However, the first sheet member may be worked to have the blind holes.

(11) The pressure producing apparatus according to the mode (10), wherein the at least one first electrode and the at least one second electrode are embedded in the first sheet member such that the first and second electrodes extend from the first surface of the first sheet member in a direction of thickness thereof.

This mode (11) can enjoy the same advantage as that of the mode (2).

(12) The pressure producing apparatus according to the mode (11), wherein the at least one first electrode and the at least one second electrode extend through the thickness of the first sheet member.

According to this mode, the first sheet member having the first and second electrodes can be easily manufactured, because the first sheet member can be worked to have through-holes for receiving the first and second electrodes.

(13) The pressure producing apparatus according to the mode (10), comprising a plurality of the first electrodes and a plurality of the second electrodes, wherein the first and second electrodes are embedded in a limited portion of the first sheet member that is limited in the surface direction.

This mode (13) can enjoy the same advantage as that of the mode (4).

(14) The pressure producing apparatus according to the mode (10), comprising a plurality of groups of the first electrodes and a plurality of groups of the second electrodes, wherein the plurality of groups of first electrodes are arranged along a plurality of concentric first circles, respectively, and the plurality of groups of second electrodes are arranged along a plurality of concentric second circles, respectively, and wherein the first and second circles are concentric with each other and the groups of first electrodes and the groups of second electrodes are alternate with each other in a radial direction of the concentric first and second circles.

(15) The pressure producing apparatus according to the mode (10), comprising a plurality of groups of the first electrodes and a plurality of groups of the second electrodes, wherein the plurality of groups of first electrodes are arranged along a plurality of first lines, respectively, and the plurality of groups of second electrodes are arranged along a plurality of second lines, respectively, and wherein the groups of first electrodes and the groups of second electrodes are alternate with each other in a direction intersecting the first and second lines.

The modes (14) and (15) can enjoy the same advantages as those of the modes (5) and (6), respectively.

(16) The pressure producing apparatus according to the mode (13), wherein the first sheet member has, in the first surface thereof opposite to the second sheet member, a plurality of recesses which at least partly surround the limited portion of the first sheet member in which the first and second electrodes are embedded.

This mode (16) can enjoy the same advantage as that of the mode (7).

(17) The pressure producing apparatus according to the mode (16), wherein the plurality of recesses comprise a plurality of through-holes which are formed through the thickness of the first sheet member.

According to this mode, the first sheet member having the through-holes can be easily manufactured.

(18) The pressure producing apparatus according to the mode (10), further comprising a liquid-chamber defining member which cooperates with a second surface of the second sheet member that is opposite to the first sheet member to define a liquid chamber in which a liquid is accommodated, wherein the apparatus changes a pressure of the liquid accommodated in the liquid chamber.

This mode (18) can enjoy the same advantage as that of the mode (8).

(19) The pressure producing apparatus according to the mode (18), comprising a plurality of groups of the first electrodes and a plurality of groups of the second electrodes, wherein the liquid-chamber defining member includes at least one partition wall which cooperates with the second surface of the second sheet member to define a plurality of liquid chambers in each of which the liquid is accommodated, and wherein the plurality of groups of first electrodes and the plurality of groups of second electrodes are provided in a plurality of limited portions of the first sheet member, respectively, that are aligned with the plurality of liquid chambers, respectively.

This mode (19) can enjoy the same advantage as that of the mode (9).

(20) A pressure producing apparatus, comprising a sheet member which is formed of a piezoelectric material; at least one first electrode which is embedded in at least one of a first portion and a second portion of the sheet member, the first portion and the second portion being opposite to each other in a direction of thickness of the sheet member; at least one second electrode which is embedded in the at least one of the first and second portions of the sheet member, such that the at least one second electrode is opposed to the at least one first electrode in a surface direction parallel to a first surface of the first portion and a second surface of the second portion that are opposite to each other in the direction of thickness of the sheet member; and a liquid-chamber defining member which cooperates with one of the first and second surfaces of the sheet member to define a liquid chamber in which a liquid is accommodated, wherein an electric field is applied between the at least one first electrode and the at least one second electrode, so as to produce a difference between an amount of elongation in the surface direction of the first portion of the sheet member and an amount of elongation in the surface direction of the second portion of the sheet member and thereby curve the sheet member in the direction of thickness thereof and change a pressure of the liquid accommodated in the liquid chamber.

In the present pressure producing apparatus, a single first electrode and a single second electrode may be embedded in either one of the first and second portions of the sheet member, or otherwise two first electrodes may be embedded in the first and second portions of the sheet member, respectively, while two second electrodes are embedded in the first and second portions, respectively. In the latter case, if, at an appropriate time after an electric field is applied between the first and second electrodes provided in the first portion of the sheet member, an electric field is applied between the first and second electrodes provided in the second portion, then the sheet member is deformed or curved more largely than the sheet member of the apparatus according to the mode (1). This mode (20) may be combined with any of the modes (2) through (9).

(21) The pressure producing apparatus according to the mode (20), wherein the liquid chamber of the liquid-chamber defining member accommodates an ink as the liquid, and wherein the apparatus further comprises a nozzle-defining member which defines a nozzle which communicates with the liquid chamber and ejects a droplet of the ink when the sheet member is curved in the direction of thickness thereof to change the pressure of the ink accommodated in the liquid chamber.

(22) A pressure producing apparatus, comprising a first sheet member and a second sheet member which are stacked on each other and at least one of which is formed of a piezoelectric material; at least one first electrode which is embedded in the at least one of the first sheet member and the second sheet member; at least one second electrode which is embedded in the at least one of the first sheet member and the second sheet member, such that the at least one second electrode is opposed to the at least one first electrode in a surface direction parallel to a first surface of the first sheet member and a second surface of the second sheet member that are apart from, and opposite to, each other in respective directions of thickness of the first and second sheet members; and a liquid-chamber defining member which cooperates with one of the first and second surfaces of the first and second sheet members to define a liquid chamber in which a liquid is accommodated, wherein an electric field is applied between the at least one first electrode and the at least one second electrode, so as to produce a difference between an amount of elongation in the surface direction of the first sheet member and an amount of elongation in the surface direction of the second sheet member and thereby curve the first and second sheet members in the respective directions of thickness thereof and change a pressure of the liquid accommodated in the liquid chamber.

In the present pressure producing apparatus, a single first electrode and a single second electrode may be embedded in either one of the first and second sheet members, or otherwise two first electrodes may be embedded in the first and second sheet members, respectively, while two second electrodes are embedded in the first and second sheet members, respectively. In the latter case, if, at an appropriate time after an electric field is applied between the first and second electrodes provided in the first sheet member, an electric field is applied between the first and second electrodes provided in the second sheet member, then the first and second sheet members are deformed or curved more largely than the first and second sheet members of the apparatus according to the mode (10). This mode (22) may be combined with any of the modes (11) through (19).

(23) The pressure producing apparatus according to the mode (22), wherein the liquid chamber of the liquid-chamber defining member accommodates an ink as the liquid, and wherein the apparatus further comprises a nozzle-defining member which defines a nozzle which communicates with the liquid chamber and ejects a droplet of the ink when the first and second sheet members are curved in the directions of thickness thereof to change the pressure of the ink accommodated in the liquid chamber.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENT

Hereinafter, there will be described preferred embodiments of the present invention by reference to the drawings.

First Embodiment

Figure 1:
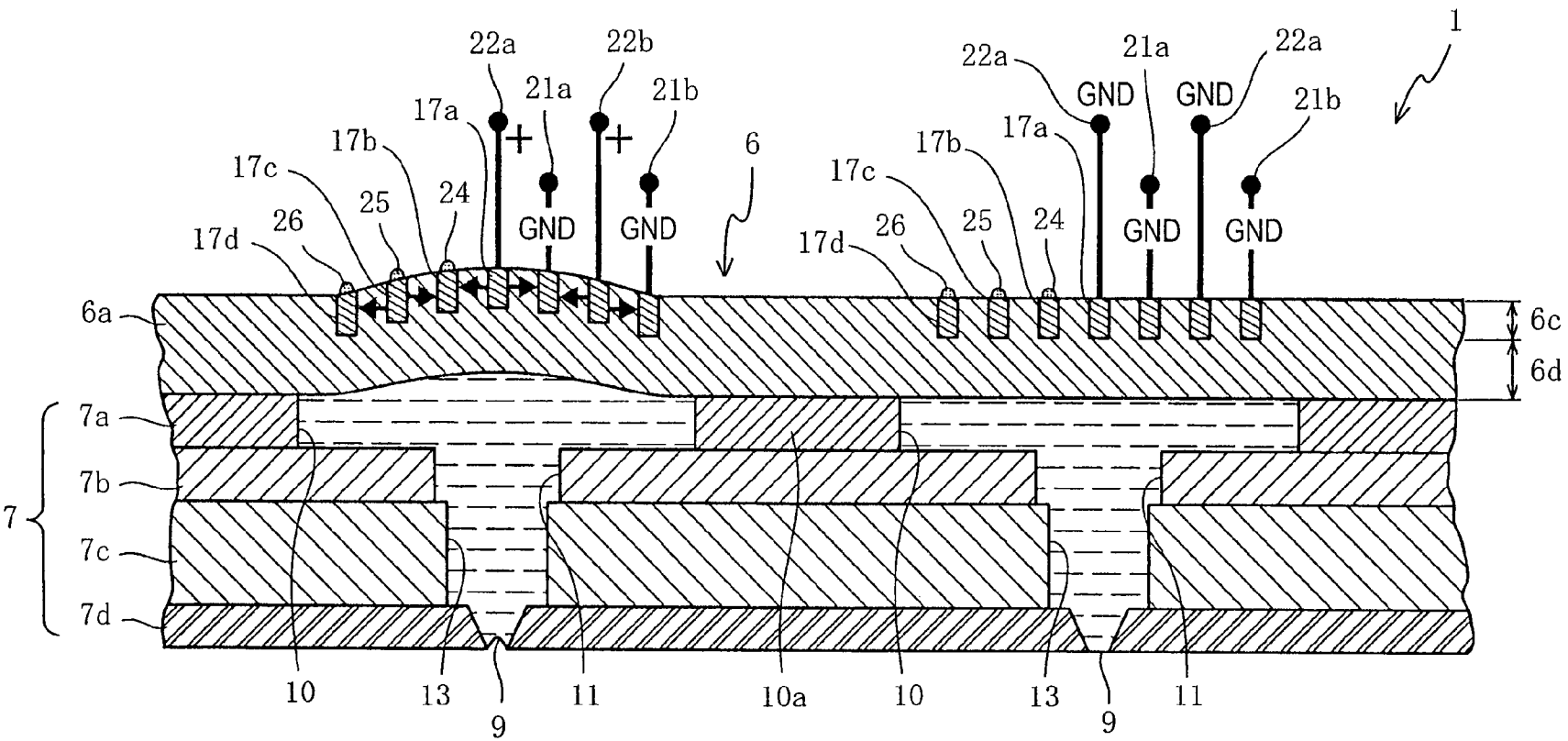
FIG. 1 is a longitudinal cross-sectional view of an essential portion of an ink jet printer head including an actuator unit as a pressure producing apparatus to which the present invention is applied.
Figure 2:
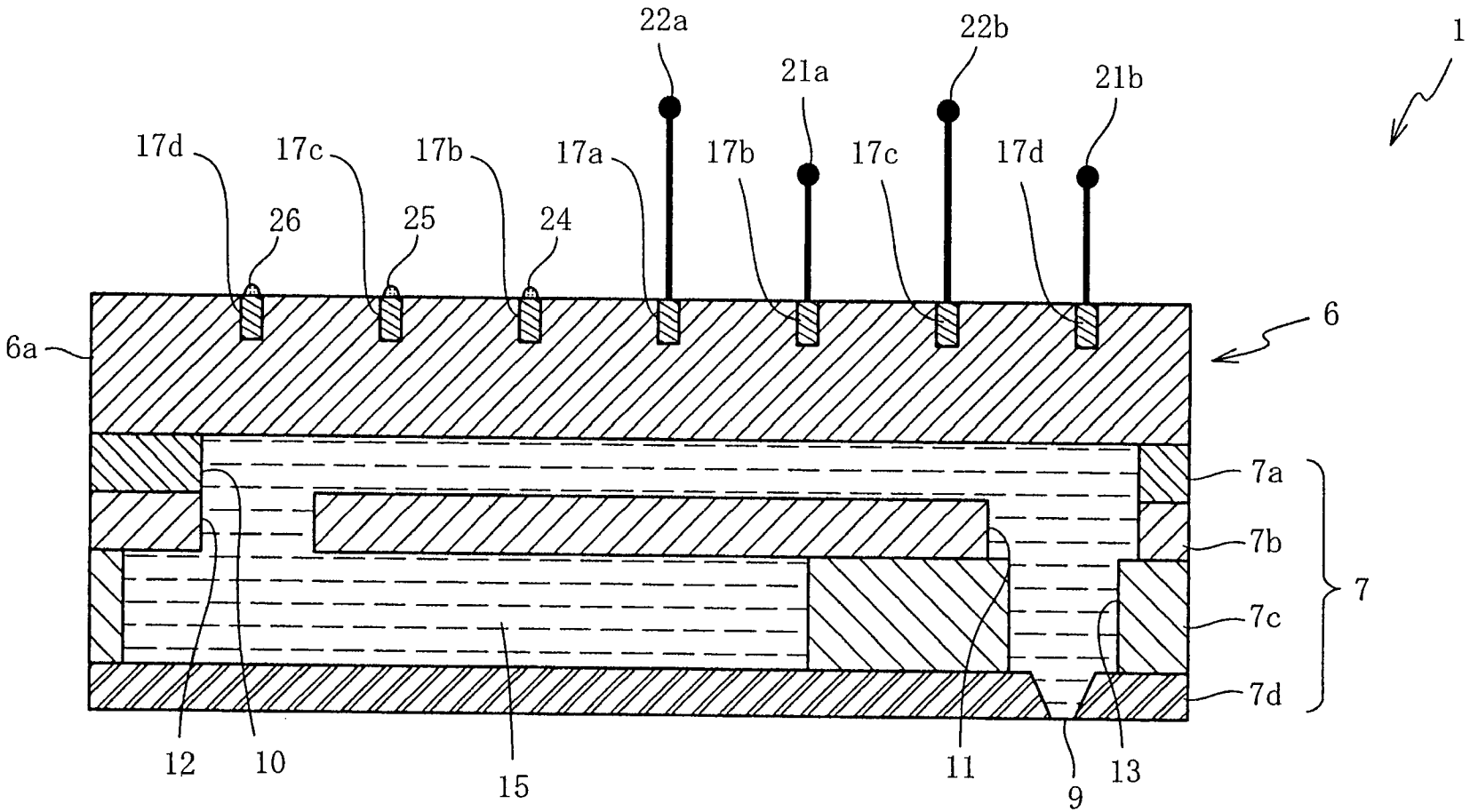
FIG. 2 is a transverse cross-sectional view of the essential portion of the printer head shown in FIG. 1.

FIGS. 1 and 2 show a piezoelectric-type ink jet printer head 1 including an actuator unit 6 as a first embodiment of a pressure producing apparatus according to the present invention. However, according to the present invention, the printer head 1 may be said as the pressure producing apparatus. FIG. 1, the piezoelectric printer head 1 includes a supply-passage unit 7 having a substantially rectangular parallelepiped shape, and the actuator unit 6 having substantially the same shape as that of the supply-passage unit 7 and stacked on the same 7. The actuator unit 6 is equipped with a flexible flat cable or a flexible printed circuit (FPC), not shown, that is connected to an external electric circuit. The printer head 1 outputs ink downward from nozzles 9 opening in a lower surface of the supply-passage unit 7.

The supply-passage unit 7 has a number of pressure chambers 10 (i.e., ink accommodating chambers) each opening upward. In addition, the supply-passage unit 7 has, in one of lengthwise opposite end portions thereof, two supply holes, not shown, that communicate between respective manifold passages 15, described later, and an ink cartridge, not shown, and are covered with respective filters, not shown, for removing dust from the ink supplied from the ink cartridge.

As shown in FIGS. 1 and 2, in the printer head 1, the actuator unit 6 is driven, via the FPC, by a drive pulse signal that is produced by a drive circuit, not shown. The drive pulse signal selectively takes a ground potential or a certain positive potential. The actuator unit 6 is stacked on the supply-passage unit 7 that defines an ink-supply passage through which the ink is supplied. The actuator unit 6 and the supply-passage unit 7 are adhered to each other using an epoxy-type thermosetting adhesive. The actuator unit 6 has terminals 21*a*, 22*a*, 21*b*, 22*b* that are connected to corresponding terminals of the FPC.

The supply-passage unit 7 includes three metallic thin sheets, i.e., a cavity sheet 7*a*, a spacer sheet 7*b*, and a manifold sheet 7*c*, and additionally includes a nozzle sheet 7*d* that has the nozzles 9 each for outputting ink and is formed of a synthetic resin such as polyimide. The four sheets 7*a*-7*d* are stacked on each other, such that the uppermost cavity sheet 7*a* is held in contact with the actuator unit 6 so as to define the pressure chambers 10.

The cavity sheet 7*a* has two arrays of pressure chambers 10, arranged in a lengthwise direction thereof, each of which has a substantially disc-like shape and accommodates ink that is selectively outputted when the actuator unit 6 is operated. The pressure chambers 10 are isolated from each other by partition walls 10*a*. The spacer sheet 7*b* has a first communication hole 11 that communicates one end of each pressure chamber 10 with the corresponding nozzle 9 and additionally has a second communication hole 12 that communicates the other end of the each pressure chamber 10 with the manifold passage 15, described later.

The manifold sheet 7*c* has a third communication hole 13 that communicates the above-indicated one end of each pressure chamber 10 with the corresponding nozzle 9. The manifold sheet 7*c* additionally has the above-indicated manifold passage 15 that supplies ink to the each pressure chamber 10. The manifold passage 15 extends, beneath each array of pressure chambers 10, in the direction of arrangement of those chambers 10. One end of the manifold passage 15 is connected to the ink cartridge (i.e., an ink supplying device), not shown, via one of the above-described supply holes. Thus, the manifold passage 15, the second communication hole 12, the pressure chamber 10, the first communication hole 11, and the third communication hole 13 cooperate with each other to provide an ink supply passage that supplies ink to each nozzle 9.

Figure 3:
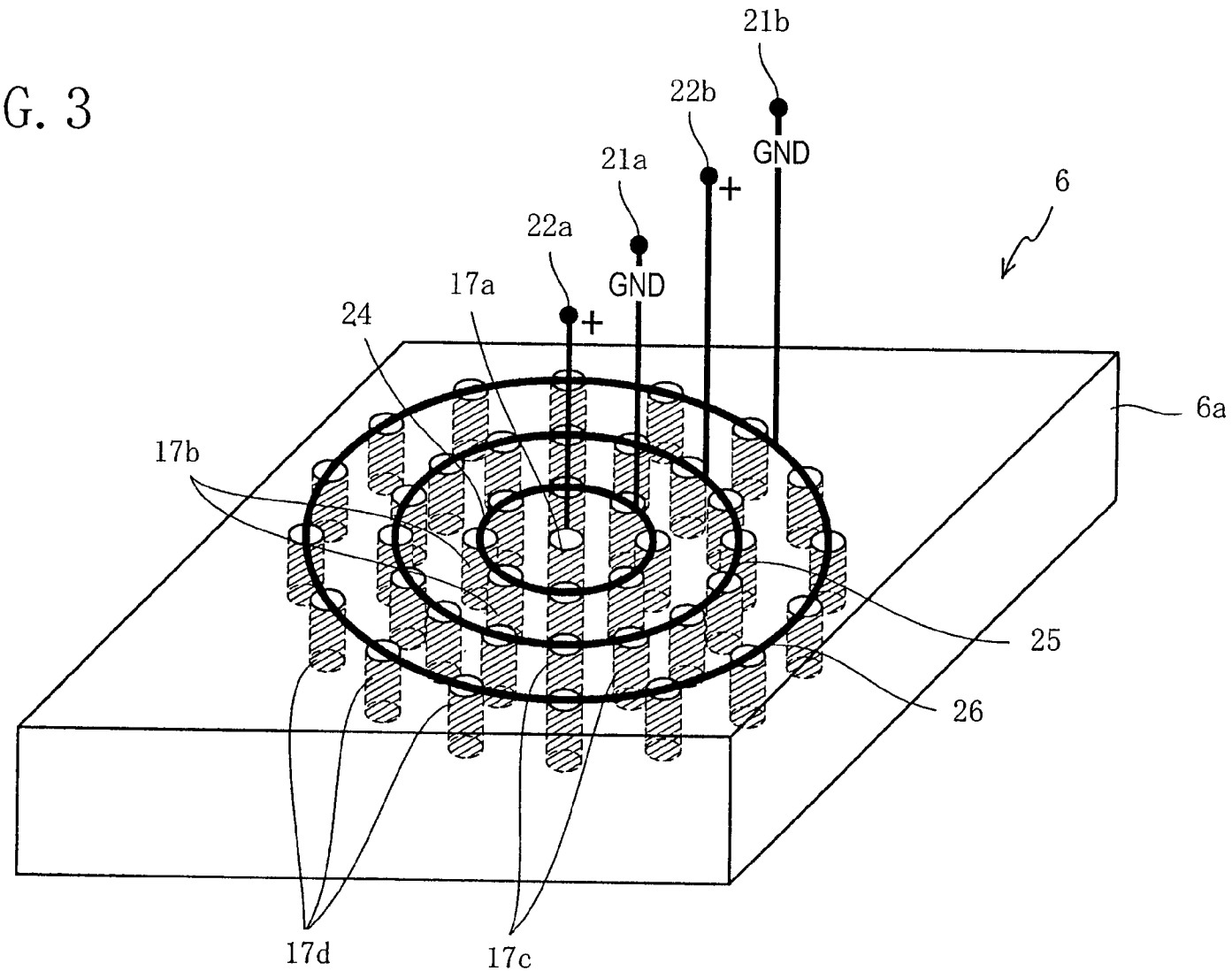
FIG. 3 is an enlarged perspective view of the actuator unit shown in FIG. 1.

As shown in FIG. 3, the actuator unit 6 includes a single piezoelectric ceramic sheet 6*a* that is formed of a ceramic material, i.e., lead zirconate titanate (PZT). As shown in FIGS. 1 and 3, four groups of cylindrical electrodes 17*a*, 17*b*, 17*c*, 17*d* are embedded in the piezoelectric sheet 6*a*, such that respective axial directions of the electrodes 17*a*-17*d* are parallel to a direction of thickness of the sheet 6*a*. An axial length of each of the electrodes 17*a*-17*d* is somewhat shorter than half the thickness of the piezoelectric sheet 6*a*, and one of axially opposite end surfaces of the each electrode 17*a*-17*d* is exposed in an upper surface of the sheet 6*a* that is opposite to the supply-passage unit 7, so that the each electrode 17*a*-17*d* does not penetrate through the sheet 6*a*. Thus, the electrodes 17*a*-17*d* are located locally in only an upper portion 6*c* of the piezoelectric sheet 6*a*, and extend in the direction of thickness thereof without penetrating the same 6*a*. The upper portion 6*c* of the piezoelectric sheet 6*a* has a thickness equal to the axial lengths of the electrodes 17*a*-17*d*.

The first group of electrode 17*a* consists of a single electrode. The second group of electrodes 17*b* are arranged along a first circle whose center is located on the central electrode 17*a*, such that the electrodes 17*b* are equidistant from each other; the third group of electrodes 17*c* are arranged along a second circle whose center is located on the central electrode 17*a* and which is larger than the first circle, such that the electrodes 17*c* are equidistant from each other; and the fourth group of electrodes 17*d* are arranged along a third circle whose center is located on the central electrode 17*a* and which is larger than the second circle, such that the electrodes 17*d* are equidistant from each other. Thus, the first, second, and third circles are concentric with each other with respect to the center on which the electrode 17*a* is located.

As can be seen from FIG. 1, the third circle along which the electrodes 17*d* are arranged has substantially the same diameter as a diameter of each pressure chamber 10, and the electrodes 17*d* are embedded in a limited portion of the upper portion 6*c* of the piezoelectric sheet 6*a* that corresponds to the pressure chamber 10. That is, all the electrodes 17*a*, 17*b*, 17*c*, 17*d* are substantially uniformly distributed in a limited portion of the actuator unit 6 that corresponds to the pressure chamber 10. However, it is not essentially required that the electrodes 17*a*, 17*b*, 17*c*, 17*d* be substantially equidistant from each other, so long as the electrodes 17*a*-17*d* are distributed all over the limited portion of the actuator unit 6 that corresponds to the pressure chamber 10.

A circular portion of the upper portion 6*c* of the piezoelectric sheet 6*a* that is located inside the third circle along which the fourth group of electrodes 17*d* are arranged, provides an active portion in which a first annular portion located between the first group of electrode 17*a* (i.e., the single electrode 17*a*) and the second group of electrodes 17*b* is polarized in a radially outward direction, a second annular portion located between the second group of electrodes 17*b* and the third group of electrodes 17*c* is polarized in a radially inward direction, and a third annular portion located between the third group of electrodes 17*c* and the fourth group of electrodes 17*d* is polarized in the radially outward direction. Thus, the respective polarization directions of the first, second, and third annular portions of the active portion are alternately changed with each other with respect to the radial direction of the three circles.

The first group of electrode 17*a* is connected to the terminal 22*a* that is supplied with a drive pulse signal that selectively takes a ground potential or a certain positive potential. The second group of electrodes 17*b* are connected to the terminal 21*a* that is always kept at a ground potential, via a circular metallic wiring 24 having the same diameter as the diameter of the first circle along which the electrodes 17*b* are arranged. The third group of electrodes 17*c* are connected to the terminal 22*b* that is supplied with the same drive pulse signal as the drive pulse signal supplied to the terminal 22*a*, via a circular metallic wiring 25 having the same diameter as the diameter of the second circle along which the electrodes 17*c* are arranged. The fourth group of electrodes 17*d* are connected to the terminal 21*b* that is always kept at the ground potential, via a circular metallic wiring 26 having the same diameter as the diameter of the third circle along which the electrodes 17*d* are arranged. Thus, in the present embodiment, the respective electric potentials of the electrode 17*a* and the electrodes 17*c* are always equal to each other, and the respective electric potentials of the electrodes 17*b* and the electrodes 17*d* are always equal to each other. Therefore, the four groups of electrodes 17*a*, 17*b*, 17*c*, 17*d* can be classified into first electrodes consisting of the electrodes 17*a*, 17*c* and second electrodes consisting of the electrodes 17*b*, 17*d*.

As can be understood from the foregoing description, when the first and third groups of electrodes 17*a*, 17*c* take the ground potential, no electric fields are produced between each pair of next groups of electrodes that are next to each other in the radial direction of the circles, i.e., between the first group of electrode 17*a* and the second group of electrodes 17*b*, between the second group of electrodes 17*b* and the third group of electrodes 17*c*, or between the third group of electrodes 17*c* and the fourth group of electrodes 17*d*. On the other hand, when the first and third groups of electrodes 17*a*, 17*c* take the positive potential, an electric field is produced between each pair of next groups of electrodes.

FIG. 1 shows two pressure chambers 10. The left-hand pressure chamber 10 shows a state in which the electrodes 17*a*, 17*c* take the positive potential, and the right-hand pressure chamber 10 shows a state in which the electrodes 17*a*, 17*c* take the ground potential. More specifically explained, when the electrodes 17*a*, 17*c* take the positive potential, three electric fields whose directions are all parallel to a surface direction parallel to the upper surface of the piezoelectric sheet 6*a*, and are indicated at arrows in FIG. 1, are produced between the above-described three pairs of next groups of electrodes. Respective directions of the respective electric fields produced in the above-described first, second, and third annular portions of the active portion are the same as the respective polarization directions of the first, second, and third portions of the active portion. As a result, the first, second, and third annular portions of the active portion that are sandwiched by the four groups of electrodes 17*a*, 17*b*, 17*c*, 17*d* are caused, because of piezoelectric effect, to elongate in the surface direction.

The piezoelectric sheet 6*a* includes, in addition to the upper portion 6*c* thereof, a lower portion 6*d* which is adjacent to the upper portion 6*c* in the direction of thickness of the sheet 6*a* and in which no electrodes 17*a*-17*d* are provided. When the electric fields are applied to the active portion of the upper portion 6*c*, no electric fields are applied to the lower portion 6*d* and accordingly no forces are produced to elongate the lower portion 6*d* in the surface direction. As a result, a difference is produced between an amount of elongation in the surface direction of the upper portion 6*c* and an amount of elongation in the surface direction of the lower portion 6*d*, and the lower portion 6*d* resists the elongation of the upper portion 6*c* in the surface direction. Thus, the actuator unit 6 is operated in a manner similar to the manner in which the unimorph-type actuator unit disclosed by the previously-indicated Japanese Patent Document No. 6-316070 is operated. More specifically explained, as shown in the left-hand half portion of FIG. 1, the piezoelectric sheet 6*a* is curved in the direction of thickness thereof so that the upper portion thereof swells upward. At the same time, a lower surface of the sheet 6*a* that contacts the ink accommodated in the pressure chamber 10 is curved in a direction to cause expansion of the chamber 10. As a result, the ink flows from the manifold passage 15 into the expanded chamber 10, and fills the same 10.

Subsequently, when the electrodes 17*a*, 17*c* take the ground potential, the electric fields are removed, and the piezoelectric sheet 6*a* returns, as shown in the right-hand half portion of FIG. 1, to its initial, flat shape owing to its own elasticity. As a result, the lower surface of the sheet 6*a* returns to its original position, so that the volume of the pressure chamber 10 is decreased as compared with its state shown in the left-hand half portion of FIG. 1. Thus, a pressure is applied to the ink accommodated in the pressure chamber 10, and a droplet of ink is ejected from the nozzle 9 communicating with the chamber 10.

The ink jet printer head 1 shown in FIGS. 1 through 3 can output ink in either a "push-and-shoot" method or a "draw-and-shoot" method. In the push-and-shoot method, in a normal or initial state of the printer head 1, the electrodes 17*a*, 17*c* corresponding to all the pressure chambers 10 take the positive potential, so that the electric fields are applied to the active portions of the upper portion 6*c* of the piezoelectric sheet 6*a* and the sheet 6*a* is curved as shown in the left-hand half portion of FIG. 1. When only the electrodes 17*a*, 17*c* corresponding to one or more pressure chambers 10 that is or are desired to output ink are caused to take the ground potential, the electric fields are removed from one or more active portions corresponding to the one or more pressure chambers 10, so that the volume or volumes of the pressure chamber or chambers is or are decreased to apply pressure to the ink.

Meanwhile, in the "draw-and-shoot" method, in the initial state of the printer head 1, the electrodes 17*a*, 17*c* corresponding to all the pressure chambers 10 take the ground potential, so that no electric fields are applied to the active portions of the upper portion 6*c* of the piezoelectric sheet 6*a* and the sheet 6*a* is kept flat as shown in the right-hand half portion of FIG. 1. When only the electrodes 17*a*, 17*c* corresponding to one or more pressure chambers 10 that is or are desired to output ink are caused to take the positive potential, the electric fields are applied to one or more active portions corresponding to the one or more pressure chambers 10 and thereby curve the corresponding portion or portions of the piezoelectric sheet 6*a*, so that the volume or volumes of the pressure chamber or chambers 10 is or are increased. As a result, a pressure wave is produced in the pressure chamber 10 or each pressure chamber 10, and propagates in a lengthwise direction thereof. Subsequently, at a timing when the pressure wave takes a positive pressure, the electrodes 17*a*, 17*c* are caused to take the ground potential, again, so as to remove the electric fields from the active portion or portions and thereby decrease the volume or volumes of the pressure chamber or chambers 10, as shown in the right-hand half portion of FIG. 1. Thus, a pressure is applied to the ink accommodated in the chamber or chambers 10. In the "draw-and-shoot" method, since the two pressures can be added to each other, a considerably small energy can be used to apply a considerably high pressure to ink.

Next, there will be briefly described a method of manufacturing the ink jet printer head 1 as described above, by reference to FIGS. 1 through 3. The printer head 1 is manufactured by first producing components, such as the supply-passage unit 7 and the actuator unit 6, separately from each other, and then assembling those components into the head 1.

The supply-passage unit 7 is produced as follows: First, the four sheets 7*a*, 7*b*, 7*c*, 7*d*, shown in FIGS. 1 and 2, are formed independently of each other and, then, those sheets 7*a*-7*d* are positioned relative to each other, stacked on each other, and adhered to each other with an adhesive. Etching is used to form the pressure chambers 10, the communication holes 11, 12, 13, and the manifold passage 15 in the sheets 7*a*, 7*b*, 7*c*; and a laser is used to form the nozzles 9 in the sheet 7*d*.

The actuator unit 6 is produced as follows: First, a green sheet is formed of a piezoelectric material, and a press or a laser is used to form, in each of respective portions of the green sheet that correspond to the pressure chambers 10, a number of cylindrical recesses to be used to receive electrodes. Pressing is very advantageous because it can be carried out simultaneously when the green sheet is formed into a prescribed shape corresponding to the actuator unit 6.

Subsequently, an electrically conducting material in the form of a paste is cast in each of the cylindrical recesses of the piezoelectric-ceramic green sheet and, then, the green sheet is degreased, and fired at an appropriate temperature, as various sorts of ceramic green sheets are done. Thus, the piezoelectric-ceramic sheet 6*a* having the electrodes 17*a*-17*d* in the cylindrical recesses is obtained. In addition, printing or vapor deposition is used to connect the metallic wirings 24, 25, 26 to the second, third, and fourth groups of electrodes 17*b*, 17*c*, 17*d*, respectively. Thus, the actuator unit 6 is obtained. The dimensions of the piezoelectric-ceramic green sheet are designed in view of amounts of shrinkage thereof due to firing.

Then, the supply-passage unit 7 and the actuator unit 6 are adhered to each other with a thermosetting adhesive, such that the respective positions of the active portions of the actuator unit 6 are aligned with the respective positions of the corresponding pressure chambers 10 of the supply-passage unit 7. As a result, respective portions of the actuator unit 6 that are located outside the active portions thereof are fixed to the partition walls 10*a* of the cavity sheet 7*a*. Subsequently, the actuator unit 6 and the FPC are bonded to each other with solder such that the terminals 21*a*, 22*a*, 21*b*, 22*b* of the actuator unit 6 and the corresponding terminals of the FPC are superposed on each other.

Then, in a state in which the electrodes 17*b*, 17*d* are kept at a ground potential, a positive high potential is applied to the electrodes 17*a*, 17*c*, so as to polarize the first, second, and third annular portions of the piezoelectric sheet 6*a*, located between the four groups of electrodes 17*a*-17*d*, in the direction in which the electrodes are opposed to each other, i.e., in the surface direction, and thereby provide an active portion corresponding to each pressure chamber 10. Thus, the ink jet printer head 1 is manufactured.

In the above-described manufacturing method, a laser may be used to form the cylindrical recesses, after the green sheet is fired. In addition, the electrodes 17*a*-17*d* may be disposed in the cylindrical recesses, after the green sheet is fired. Moreover, the actuator unit 6 and the FPC may be bonded to each other, after the actuator unit 6 is subjected to the above-described polarization step. In the last case, it is needed to apply the electric potentials to the electrodes 17*a*-17*d*, using an electric circuit other than the FPC.

In the actuator unit 6 as the first embodiment of the pressure producing apparatus, the potential difference between the first electrodes 17*a*, 17*c* and the second electrodes 17*b*, 17*d*, all of which are embedded in the single piezoelectric sheet 6*a* and do not penetrate the same 6*a*, is controlled to switch the sheet 6*a* to either a curved state in which the sheet 6*a* is curved in the direction of thickness thereof, or a non-curved state in which the sheet 6*a* is not curved. Thus, a pressure can be applied to the ink accommodated in a desired one or ones of the pressure chambers 10, so as to output the ink from the desired pressure chamber or chambers 10.

In addition, the present actuator unit 6 can be easily manufactured in the simple step in which the electrodes 17*a*-17*d* are embedded in the piezoelectric sheet 6*a* such that the electrodes extend inward from one surface thereof by the distance shorter than the thickness thereof. Thus, the actuator unit 6 enjoys an advantage that it can be manufactured at low cost. Moreover, the actuator unit 6 does not have the structure, disclosed by the previously-identified Japanese Patent Documents Nos. 2002-59547 and 2002-127420, in which a number of piezoelectric sheets and thin electrode layers are stacked on each other. Therefore, the electrodes 17*a*-17*d* embedded in the upper portion 6*c* of the piezoelectric sheet 6*a* can be isolated from the ink by the lower portion 6*d* of the same 6*a* that has a sufficiently great thickness. Thus, even if fine cracks may occur to the piezoelectric sheet 6*a*, the actuator unit 6 does not suffer from the disorder that ink leaks and short circuit occurs between electrodes next to each other. Therefore, the actuator unit 6 enjoys a high durability.

In addition, the polarization directions of each of the active portions of the piezoelectric sheet 6*a* are the same as the directions in which the electric fields are applied to the each active portion, i.e., the directions in which the electrodes 17*a*-17*d* are opposed to each other along the upper surface of the sheet 6*a*, i.e., the radial directions of the circles whose centers are located on the electrode 17*a*. Therefore, the piezoelectric sheet 6*a* is curved in the direction of thickness thereof such that the upper portion 6*c* of the sheet 6*a* swells out, on the basis of a principle analogous to the principle of the previously-described unimorph-type actuator unit. Thus, a pressure can be applied to the ink present in each pressure chamber 10.

In addition, in the actuator unit 6, many electrodes 17*a*-17*d* are embedded in each active portion of the piezoelectric sheet 6*a*. Therefore, in the actuator unit 6, the distances between the electrodes 17*a*-17*d* and the respective surface areas of the same 17*a*-17*d* can be decreased as compared with the actuator unit, disclosed by the Japanese Patent Documents Nos. 2002-59547 and 2002-127420, in which piezoelectric sheets and large-size electrodes are stacked on each other. Accordingly, the electric potentials applied to the electrodes 17*a*, 17*c* and the electrostatic capacitance of the actuator unit 6 can be decreased. Thus, driver ICs and electric circuits of the printer head 1 can be produced at low cost and amounts of energy and heat consumed and generated by the head 1 can be reduced.

Moreover, in the actuator unit 6, the three groups of electrodes 17*b*, 17*c*, 17*d* are arranged along the three circles, respectively, that are concentric with respect to the central electrode 17*a*, such that the first electrodes (i.e., the first and third groups of electrodes 17*a*, 17*c*) and the second electrodes (i.e., the second and fourth groups of electrodes 17*b*, 17*d*) are alternate with each other in the radial direction of those circles. Therefore, strong electric fields are produced and the piezoelectric sheet 6*a* is largely deformed.

In addition, in the actuator unit 6, the lower portion 6*d* of the piezoelectric sheet 6*a* partly define the pressure chambers 10. Therefore, in the above-described "draw-and-shoot" method, it is not needed to apply, in the normal or initial state, the electric fields to the piezoelectric sheet 6*a*. Thus, as compared with a case where the upper portion 6*c* of the piezoelectric sheet 6*a* partly define pressure chambers, the total time in which the electric fields are applied to the sheet 6*a* can be significantly decreased, the amount of energy consumed by the actuator unit 6 can be reduced, and additionally the safety of the unit 6 can be improved.

In addition, in the actuator unit 6 or the printer head 1, the plurality of pressure chambers 10 separated from each other by the partition walls 10*a* are provided beneath the lower portion 6*d* of the piezoelectric sheet 6*a*, and the electrodes 17*a*-17*d* are embedded in the active portions of the sheet 6*a* that correspond to each of the pressure chambers 10. Therefore, a pressure can be efficiently applied to the ink stored in the each chamber 10.

Next, there will be described a modified form 36 of the actuator unit 6 as the first embodiment of the present invention, by reference to FIG. 4. The modified actuator unit 36 shown in FIG. 4 is used, like the actuator unit 6 shown in FIGS. 1 through 3, with the supply-passage unit 7 and the FPC as the components of the ink jet printer head 1.

Figure 4:
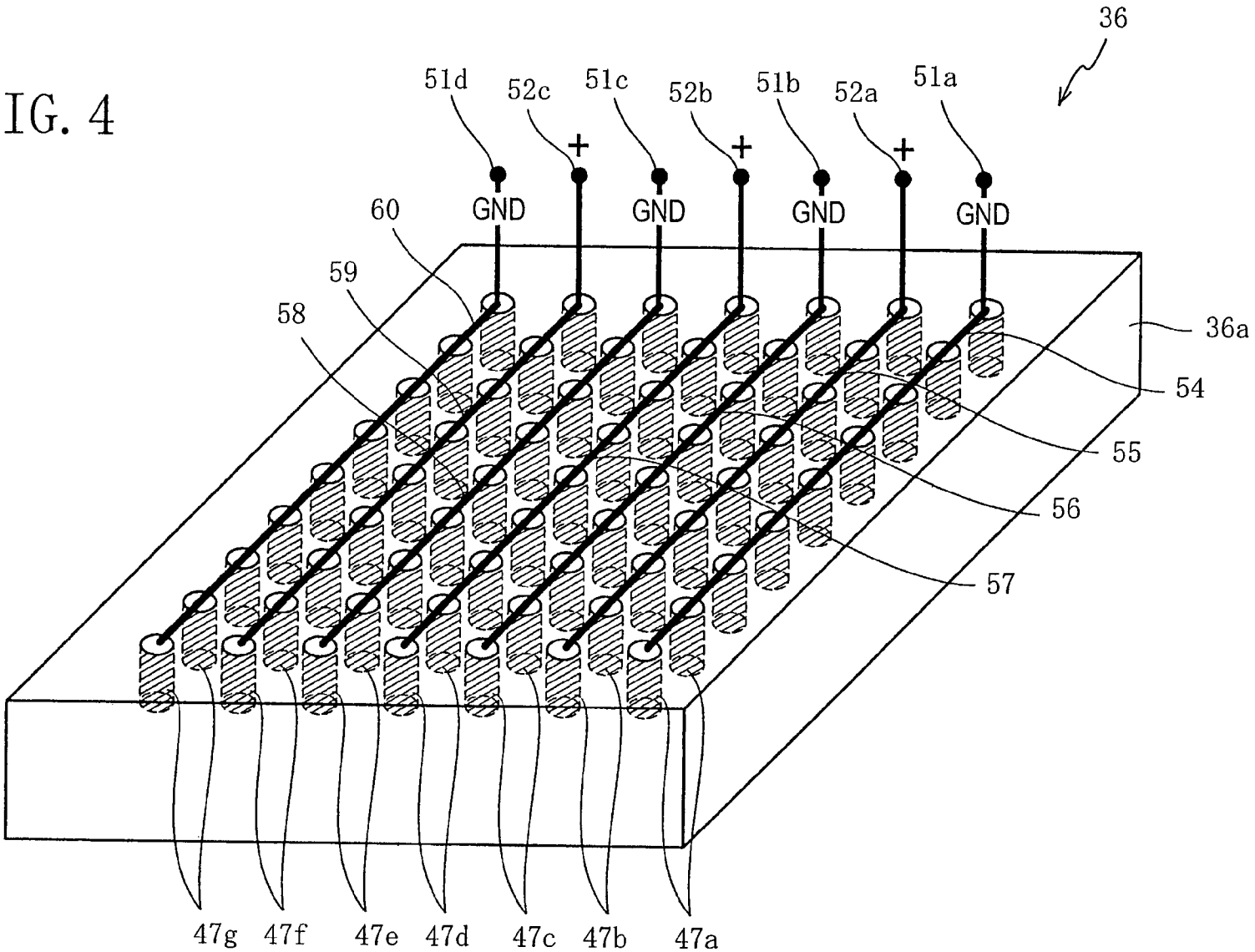
FIG. 4 is a perspective view of a modified form of the actuator unit shown in FIG. 1.

As shown in FIG. 4, the actuator unit 36 includes a single piezoelectric ceramic sheet 36*a* that is formed of a ceramic material, i.e., lead zirconate titanate (PZT). Seven groups of cylindrical electrodes 47*a*, 47*b*, 47*c*, 47*d*, 47*e*, 47*f*, 47*g* are embedded in the piezoelectric sheet 36*a*, such that respective axial directions of the electrodes 47*a*-47*g* are parallel to a direction of thickness of the sheet 36*a*. An axial length of each of the electrodes 47*a*-47*g* is somewhat shorter than half the thickness of the piezoelectric sheet 36*a*, and one of axially opposite end surfaces of the each electrode 47*a*-47*g* is exposed in an upper surface of the sheet 36*a* that is opposite to the supply-passage unit 7, so that the each electrode 47*a*-47*g* does not penetrate through the sheet 36*a*. Thus, the electrodes 47*a*-47*g* are located locally in only an upper portion of the piezoelectric sheet 36*a*, and extend in the direction of thickness of the same 36*a* without penetrating the same 36*a*. The upper portion of the piezoelectric sheet 36*a* has a thickness equal to the axial lengths of the electrodes 47*a*-47*g*.

The seven groups of electrodes 47*a*-47*g* are arranged along seven straight lines, respectively, such that the electrodes are equidistant from each other on each of the straight lines. The straight lines are parallel to each other and are equidistant from each other. Thus, the electrodes 47*a*-47*g* define a matrix. The actuator unit 36 and the supply-passage unit 7 are adhered to each other such that a limited portion of the upper portion of the piezoelectric sheet 36*a* in which the electrodes 47*a*-47*g* are embedded corresponds to a pressure chamber 10 of the supply-passage unit 7. Thus, all the electrodes 47*a*-47*g* are substantially uniformly distributed in a limited portion of the actuator unit 36 that corresponds to the pressure chamber 10 of the supply-passage unit 7.

The above-indicated limited portion of the upper portion of the piezoelectric sheet 36*a* where the seven groups of electrodes 47*a*-47*g* are embedded, provides an active portion in which a first linear portion located between the first group of electrodes 47*a* and the second group of electrodes 47*b* is polarized in a first direction from the electrodes 47*b* toward the electrodes 47*a*; a second linear portion located between the second group of electrodes 47*b* and the third group of electrodes 47*c* is polarized in a second direction from the electrodes 47*b* toward the electrodes 47*c*; a third linear portion located between the third group of electrodes 47*c* and the fourth group of electrodes 47*d* is polarized in a third direction from the electrodes 47*d* toward the electrodes 47*c*; a fourth linear portion located between the fourth group of electrodes 47*d* and the fifth group of electrodes 47*e* is polarized in a fourth direction from the electrodes 47*d* toward the electrodes 47*e*; a fifth linear portion located between the fifth group of electrodes 47*e* and the sixth group of electrodes 47*f* is polarized in a fifth direction from the electrodes 47*f* toward the electrodes 47*e*; and a sixth linear portion located between the sixth group of electrodes 47*f* and the seventh group of electrodes 47*g* is polarized in a sixth direction from the electrodes 47*f* toward the electrodes 47*g*. The first to sixth directions are parallel to a surface direction parallel to the upper surface of the piezoelectric sheet 6*a*, and are perpendicular to the seven straight lines. Thus, the respective polarization directions of the first to sixth linear portions of the active portion are alternately changed with each other with respect to a direction perpendicular to the straight lines.

The first group of electrodes 47*a* are connected to a terminal 51*a* that is always kept at a ground potential, via a straight metallic wiring 54 provided along the first straight line along which the electrodes 47*a* are arranged. The second group of electrodes 47*b* are connected to a terminal 52*a* that is supplied with a drive pulse signal that selectively takes the ground potential or a certain positive potential, via a straight metallic wiring 55 provided along the second straight line along which the electrodes 47*b* are arranged. The third group of electrodes 47*c* are connected to a terminal 51*b* that is always kept at the ground potential, via a straight metallic wiring 56 provided along the third straight line along which the electrodes 47*c* are arranged. The fourth group of electrodes 47*d* are connected to a terminal 52*b* that is supplied with the drive pulse signal that selectively takes the ground potential or the positive potential, via a straight metallic wiring 57 provided along the fourth straight line along which the electrodes 47*d* are arranged. The fifth group of electrodes 47*e* are connected to a terminal 51*c* that is always kept at the ground potential, via a straight metallic wiring 58 provided along the fifth straight line along which the electrodes 47*e* are arranged. The sixth group of electrodes 47*f* are connected to a terminal 52*c* that is supplied with the drive pulse signal that selectively takes the ground potential or the positive potential, via a straight metallic wiring 59 provided along the sixth straight line along which the electrodes 47*f* are arranged. The seventh group of electrodes 47*g* are connected to a terminal 51*d* that is always kept at the ground potential, via a straight metallic wiring 60 provided along the seventh straight line along which the electrodes 47*g* are arranged.

Thus, the common drive pulse signal is applied to the terminals 52*a*, 52*b*, 52*c*. That is, in the present embodiment, the respective electric potentials of the electrodes 47*b*, 47*d*, 47*f* are always equal to each other, and the respective electric potentials of the electrodes 47*a*, 47*c*, 47*e*, 47*g* are always equal to each other, i.e., always equal to the ground potential. Therefore, the seven groups of electrodes 47*a*, 47*b*, 47*c*, 47*d*, 47*e*, 47*f*, 47*g* can be classified into first electrodes consisting of the electrodes 47*b*, 47*d*, 47*f* and second electrodes consisting of the electrodes 47*a*, 47*c*, 47*e*, 47*g*.

As can be understood from the foregoing description, when the electrodes 47*b*, 47*d*, 47*f* take the ground potential, no electric fields are produced in the linear portion located between each pair of next groups of electrodes that are next to each other in the direction perpendicular to the straight lines, i.e., between the electrodes 47*a* and the electrodes 47*b*, between the electrodes 47*b* and the electrodes 47*c*, between the electrodes 47*c* and the electrodes 47*d*, between the electrodes 47*d* and the electrodes 47*e*, between the electrodes 47*e* and the electrodes 47*f*, or between the electrodes 47*f* and the electrodes 47*g*. On the other hand, when the electrodes 47*b*, 47*d*, 47*f* take the positive potential, an electric field is produced in the liner portion located between each pair of next groups of electrodes.

Respective directions of the respective electric fields produced in the above-described six linear portions of the active portion of the piezoelectric sheet 36*a* are the same as the respective polarization directions of the six linear portions of the active portion. As a result, the six linear portions of the active portion of the piezoelectric sheet 6*a* that are sandwiched by the seven groups of electrodes 47*a*-47*g* are caused, because of piezoelectric effect, to elongate in the surface direction. The piezoelectric sheet 36*a* includes, in addition to the upper portion thereof, a lower portion which is adjacent to the upper portion in the direction of thickness of the sheet 36*a* and in which no electrodes 47*a*-47*g* are provided. When the electric fields are applied to the active portion of the upper portion, no electric fields are applied to the lower portion and accordingly no forces are produced to elongate the lower portion in the surface direction. As a result, a difference is produced between an amount of elongation in the surface direction of the upper portion and an amount of elongation in the surface direction of the lower portion, and the lower portion resists the elongation of the upper portion in the surface direction. Thus, the actuator unit 36 is operated in a manner similar to the manner in which the unimorph-type actuator unit disclosed by the previously-indicated Japanese Patent Document No. 6-316070 is operated. More specifically explained, the piezoelectric sheet 36*a* is curved in the direction of thickness thereof so that the upper portion thereof swells out. At the same time, a lower surface of the sheet 36*a* that contacts the ink accommodated in the pressure chamber 10 is curved in a direction to cause expansion of the chamber 10. As a result, the ink flows from the manifold passage 15 into the expanded chamber 10, and fills the same 10.

Subsequently, when the electrodes 47*b*, 47*d*, 47*f* take the ground potential, the electric fields are removed, and the piezoelectric sheet 36*a* returns to its initial, flat shape owing to its own elasticity. As a result, the lower surface of the sheet 36*a* returns to its original position, so that the volume of the pressure chamber 10 is decreased. Thus, a pressure is applied to the ink accommodated in the pressure chamber 10, and a droplet of ink is ejected from the nozzle 9 communicating with the chamber 10.

The present, modified actuator unit 36 enjoys the same advantages as described above in connection with the first embodiment shown in FIGS. 1 through 3.

Second Embodiment

Figure 5:
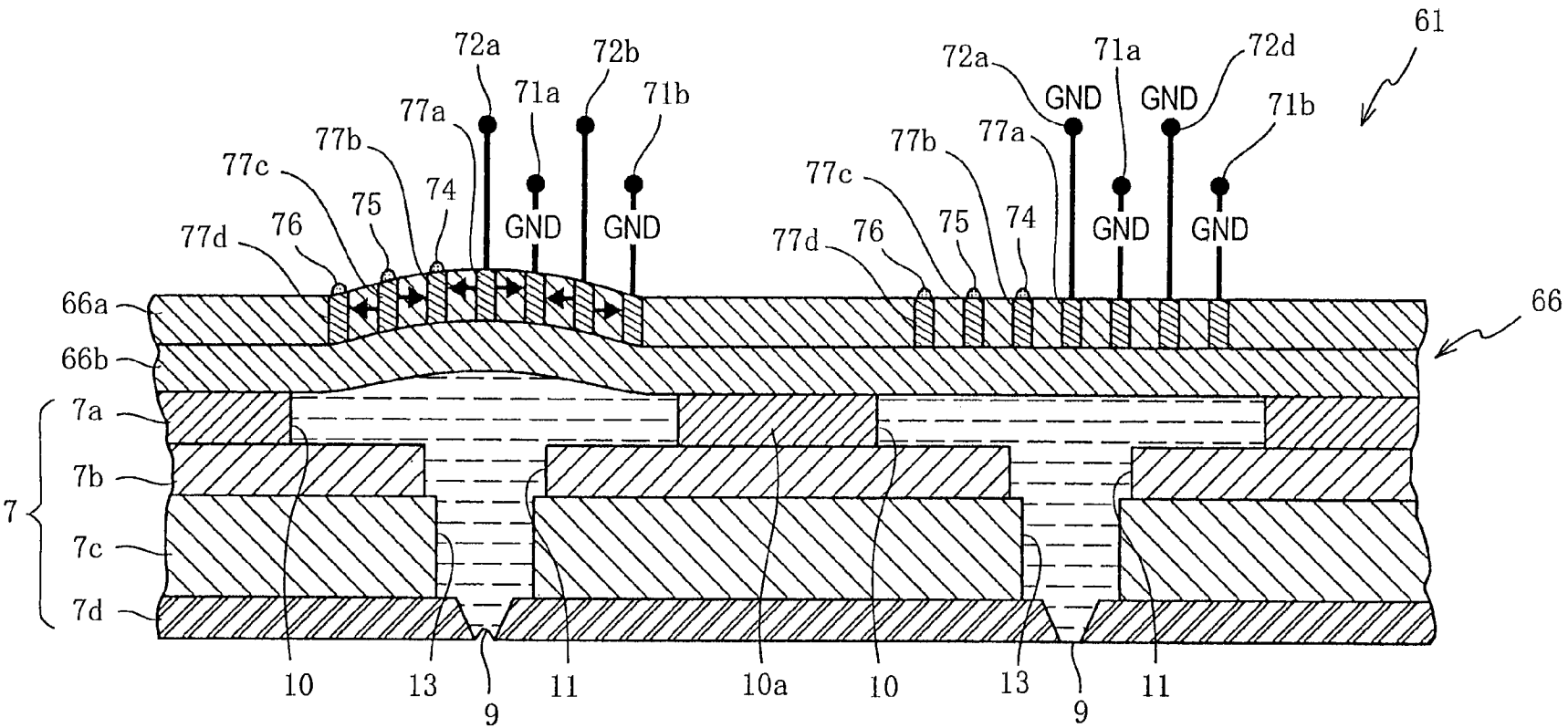
FIG. 5 is a longitudinal cross-sectional view corresponding to FIG. 1 and showing an essential portion of another ink jet printer head including another actuator unit as a second embodiment of the pressure producing apparatus.

FIG. 5 shows a piezoelectric-type ink jet printer head 61 including an actuator unit 66 as a second embodiment of a pressure producing apparatus according to the present invention. However, according to the present invention, the printer head 61 may be said as the pressure producing apparatus. The same reference numerals as used in the first embodiment shown in FIGS. 1 through 3 are used to designate the corresponding elements of the second embodiment, and the description of those elements is omitted. In FIG. 5, the piezoelectric printer head 61 includes a supply-passage unit 7 having a substantially rectangular parallelepiped shape, and the actuator unit 66 having substantially the same shape as that of the supply-passage unit 7 and stacked on the same 7.

The actuator unit 66 is equipped with a flexible flat cable or a flexible printed circuit (FPC), not shown, that is connected to an external electric circuit. The printer head 61 outputs ink downward from nozzles 9 opening in a lower surface of the supply-passage unit 7.

As shown in FIG. 5, in the printer head 61, the actuator unit 66 is driven, via the FPC, by a drive pulse signal that is produced by a drive circuit, not shown. The drive pulse signal selectively takes a ground potential or a certain positive potential. The actuator unit 66 is stacked on the supply-passage unit 7 that defines an ink-supply passage through which the ink is supplied to the nozzles 9. The actuator unit 66 and the supply-passage unit 7 are adhered to each other using an epoxy-type thermosetting adhesive. The actuator unit 66 has terminals 71*a*, 72*a*, 71*b*, 72*b* that are connected to corresponding terminals of the FPC.

Figure 6:
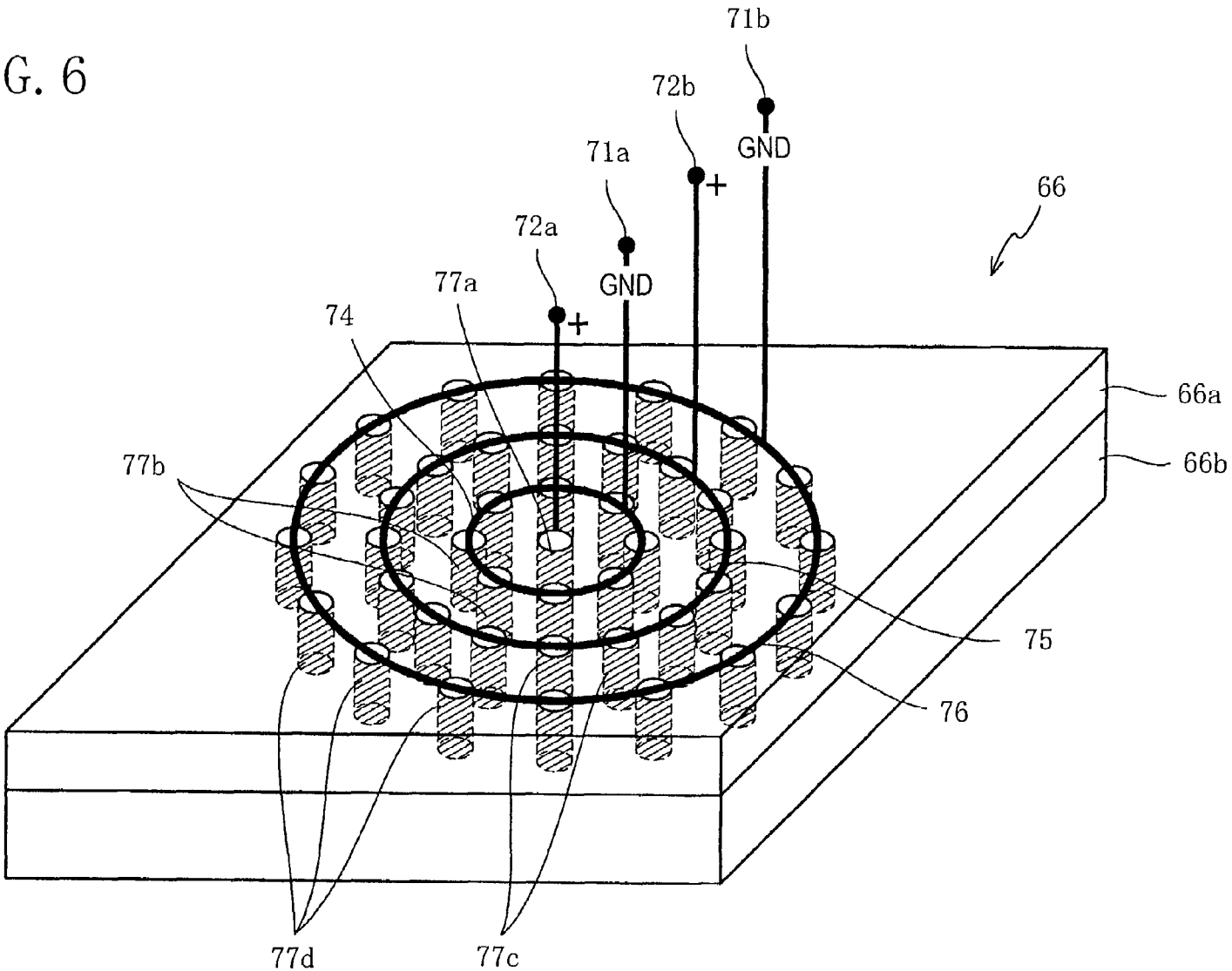
FIG. 6 is an enlarged perspective view of the actuator unit shown in FIG. 5.

As shown in FIG. 6, the actuator unit 66 includes two piezoelectric ceramic sheets 66*a*, 66*b* that are formed of a ceramic material, i.e., lead zirconate titanate (PZT) so as to have a substantially same thickness, and are stacked on each other. As shown in FIGS. 5 and 6, four groups of cylindrical electrodes 77*a*, 77*b*, 77*c*, 77*d* are embedded in the piezoelectric sheet 66*a*, such that respective axial directions of the electrodes 77*a*-77*d* are parallel to a direction of thickness of the sheet 66*a*. An axial length of each of the electrodes 77*a*-77*d* is substantially the same as the thickness of the piezoelectric sheet 66*a*. That is, the electrodes 77*a*-77*d* have substantially the same length as the thickness of the first piezoelectric sheet 66*a*, and extend through the thickness of the first sheet 66*a* without protruding into the second piezoelectric sheet 66*b*.

The first group of electrode 77*a* consists of a single electrode. The second group of electrodes 77*b* are arranged along a first circle whose center is located on the central electrode 77*a*, such that the electrodes 77*b* are equidistant from each other; the third group of electrodes 77*c* are arranged along a second circle whose center is located on the central electrode 77*a* and which is larger than the first circle, such that the electrodes 77*c* are equidistant from each other; and the fourth group of electrodes 77*d* are arranged along a third circle whose center is located on the central electrode 77*a* and which is larger than the second circle, such that the electrodes 77*d* are equidistant from each other. Thus, the first, second, and third circles are concentric with each other with respect to the center on which the electrode 77*a* is located.

As can be seen from FIG. 5, the third circle along which the electrodes 77*d* are arranged has substantially the same diameter as a diameter of each pressure chamber 10, and the electrodes 77*d* are embedded in a limited portion of the piezoelectric sheet 66*a* that corresponds to the pressure chamber 10. That is, all the electrodes 77*a*, 77*b*, 77*c*, 77*d* are substantially uniformly distributed in a limited portion of the actuator unit 66 that corresponds to the pressure chamber 10.

Like the first embodiment shown in FIG. 1, a circular portion of the piezoelectric sheet 66*a* that is located inside the third circle along which the electrodes 77*d* are arranged, provides an active portion in which a first annular portion located between the first group of electrode 77*a* (i.e., the single electrode 77*a*) and the second group of electrodes 77*b* is polarized in a radially outward direction, a second annular portion located between the second group of electrodes 77*b* and the third group of electrodes 77*c* is polarized in a radially inward direction, and a third annular portion located between the third group of electrodes 77*c* and the fourth group of electrodes 77*d* is polarized in the radially outward direction. Thus, the respective polarization directions of the first, second, and third annular portions of the active portion are alternately changed with each other with respect to the radial direction of the three circles, i.e., in a surface direction parallel to an upper surface of the upper piezoelectric sheet 66*a*.

The first group of electrode 77*a* is connected to the terminal 72*a* that is supplied with a drive pulse signal that selectively takes a ground potential or a certain positive potential. The second group of electrodes 77*b* are connected to the terminal 71*a* that is always kept at the ground potential, via a circular metallic wiring 74 having the same diameter as the diameter of the first circle along which the electrodes 77*b* are arranged. The third group of electrodes 77*c* are connected to the terminal 72*b* that is supplied with the same drive pulse signal as the drive pulse signal supplied to the terminal 72*a*, via a circular metallic wiring 75 having the same diameter as the diameter of the second circle along which the electrodes 77*c* are arranged. The fourth group of electrodes 77*d* are connected to the terminal 71*b* that is always kept at the ground potential, via a circular metallic wiring 76 having the same diameter as the diameter of the third circle along which the electrodes 77*d* are arranged. Thus, in the present embodiment, the respective electric potentials of the electrode 77*a* and the electrodes 77*c* are always equal to each other, and the respective electric potentials of the electrodes 77*b* and the electrodes 77*d* are always equal to each other. Therefore, the four groups of electrodes 77*a*, 77*b*, 77*c*, 77*d* can be classified into first electrodes consisting of the electrodes 77*a*, 77*c* and second electrodes consisting of the electrodes 77*b*, 77*d*.

As can be understood from the above description, when the first and third groups of electrodes 77*a*, 77*c* take the ground potential, no electric field is produced between each pair of next groups of electrodes that are next to each other in the radial direction of the circles, i.e., between the first group of electrode 77*a* and the second group of electrodes 77*b*, between the second group of electrodes 77*b* and the third group of electrodes 77*c*, or between the third group of electrodes 77*c* and the fourth group of electrodes 77*d*. On the other hand, when the first and third groups of electrodes 77*a*, 77*c* take the positive potential, an electric field is produced between each pair of next groups of electrodes.

FIG. 5 shows two pressure chambers 10. The left-hand pressure chamber 10 shows a state in which the first and third groups of electrodes 77*a*, 77*c* take the positive potential, and the right-hand pressure chamber 10 shows a state in which the first and third groups of electrodes 77*a*, 77*c* take the ground potential. More specifically explained, when the first and third groups of electrodes 77*a*, 77*c* take the positive potential, three electric fields whose directions are all parallel to the surface direction parallel to the upper surface of the upper piezoelectric sheet 66*a*, and are indicated at arrows in FIG. 5, are produced between the above-described three pairs of next groups of electrodes. The respective directions of the respective electric fields produced in the above-described first, second, and third annular portions of the active portion are the same as the respective polarization directions of the first, second, and third annular portions of the active portion. As a result, the first, second, and third annular portions of the active portion of the piezoelectric sheet 66*a* that are sandwiched by the four groups of electrodes 77*a*, 77*b*, 77*c*, 77*d* are caused, because of piezoelectric effect, to elongate in the surface direction.

The second or lower piezoelectric sheet 66*b* includes a non-active portion which is adjacent to, and beneath, the active portion of the first or upper piezoelectric sheet 66*a*, in the direction of thickness of the sheet 66*a*, and in which no electrodes 77*a*-77*d* are provided. When the electric fields are applied to the active portion of the upper sheet 66*a*, no electric fields are applied to the non-active portion of the lower sheet

66*b* and accordingly no forces are produced to elongate the lower sheet 66*b* in the surface direction. As a result, a difference is produced between an amount of elongation in the surface direction of the upper piezoelectric sheet 66*a* and an amount of elongation in the surface direction of the lower piezoelectric sheet 66*b*, and the lower sheet 66*b* resists the elongation of the upper sheet 66*a* in the surface direction. Thus, the actuator unit 66 is operated in a manner similar to the manner in which the unimorph-type actuator unit disclosed by the previously-indicated Japanese Patent Document No. 6-316070 is operated. More specifically explained, as shown in the left-hand half portion of FIG. 5, the piezoelectric sheets 66*a*, 66*b* are curved in the respective directions of thickness thereof so that the two sheets 66*a*, 66*b* swells upward. Therefore, a lower surface of the lower sheet 66*b* that contacts the ink accommodated in the pressure chamber 10 is curved in a direction to cause expansion of the chamber 10. As a result, the ink flows from the manifold passage 15 into the expanded chamber 10, and fills the same 10.

Subsequently, when the first and third groups of electrodes 77*a*, 77*c* take the ground potential, the electric fields are removed, and the piezoelectric sheets 66*a*, 66*b* return, as shown in the right-hand half portion of FIG. 5, to their initial, flat shape owing to their own elasticity. As a result, the lower surface of the lower sheet 66*b* returns to its original position, so that the volume of the pressure chamber 10 is decreased as compared with its state shown in the left-hand half portion of FIG. 5. Thus, a pressure is applied to the ink accommodated in the pressure chamber 10, and a droplet of ink is ejected from the nozzle 9 communicating with the chamber 10. The present ink jet printer head 61 can output ink in either the "push-and-shoot" method or the "draw-and-shoot" method.

Next, there will be briefly described a method of manufacturing the ink jet printer head 61 as described above, by reference to FIGS. 5 and 6. The printer head 61 is manufactured by first producing components, such as the supply-passage unit 7 and the actuator unit 66, separately from each other, and then assembling those components into the head 61.

Since the supply-passage unit 7 is produced in the same steps as those employed in the first embodiment, the description of those steps is omitted. The actuator unit 66 is produced as follows: First, two green sheets are formed of a piezoelectric ceramic material, and a press or a laser is used to form, in each of respective portions of one green sheet that correspond to the pressure chambers 10, a number of cylindrical through-holes to be used to receive electrodes. Pressing is advantageous because it can be carried out simultaneously when the one green sheet is formed into a prescribed shape corresponding to the upper sheet 66*a* of the actuator unit 66.

Subsequently, after the two piezoelectric-ceramic green sheets are stacked on each other, an electrically conducting material in the form of a paste is cast in each of the cylindrical through-holes of the above-indicated one green sheet and, then, the one green sheet is degreased, and is fired at an appropriate temperature, as other sorts of ceramic green sheets are routinely done. Thus, the piezoelectric-ceramic sheets 66*a*, 66*b* having the electrodes 77*a*-77*d* in the cylindrical through-holes is obtained. In addition, printing or vapor deposition is used to connect the metallic wirings 74, 75, 76 to the second, third, and fourth groups of electrodes 77*b*, 77*c*, 77*d*, respectively. Thus, the actuator unit 66 is obtained. The dimensions of the piezoelectric-ceramic green sheets are designed in view of amounts of shrinkage thereof due to firing.

Then, the supply-passage unit 7 and the actuator unit 66 are adhered to each other with a thermosetting adhesive, such that the respective positions of the active portions of the actuator unit 66 are aligned with the respective positions of the corresponding pressure chambers 10 of the supply-passage unit 7. Subsequently, the actuator unit 66 and an FPC are bonded to each other with solder such that the terminals of the actuator unit 66 and the corresponding terminals of the FPC are superposed on each other.

Then, in a state in which the second and fourth groups of electrodes 77*b*, 77*d* are kept at a ground potential, a positive high potential is applied to the first and third groups of electrodes 77*a*, 77*c*, so as to polarize the first, second, and third annular portions of the piezoelectric sheet 66*a*, located between the four groups of electrodes 77*a*-77*d*, in the direction in which the electrodes are opposed to each other, i.e., in the surface direction, and thereby provide an active portion corresponding to each pressure chamber 10. Thus, the ink jet printer head 61 is manufactured.

In the above-described manufacturing method, a laser may be used to form the cylindrical through-holes in one of the two green sheets, after those green sheets are fired. In addition, the electrodes 77*a*-77*d* may be disposed in the cylindrical through-holes, after the green sheets are fired. Moreover, the actuator unit 66 and the FPC may be bonded to each other, after the actuator unit 66 is subjected to the above-described polarization step. In the last case, it is needed to apply the electric potentials to the electrodes 77*a*-77*d*, using an electric circuit other than the FPC.

In the actuator unit 66 as the second embodiment of the pressure producing apparatus, the potential difference between the first electrodes 77*a*, 77*c* and the second electrodes 77*b*, 77*d*, all of which are embedded in the upper piezoelectric sheet 66*a*, can be controlled to switch the two piezoelectric sheets 66*a*, 66*b* to either a curved state in which the sheets 66*a*, 66*b* are curved in the directions of thickness thereof, or a non-curved state in which the two sheets 66*a*, 66*b* are not curved. Thus, a pressure can be applied to the ink accommodated in a desired one or ones of the pressure chambers 10, so as to output the ink from the desired pressure chamber or chambers 10.

In addition, the present actuator unit 66 can be easily manufactured by employing the simple steps in which the electrodes 77*a*-77*d* are embedded in the one piezoelectric sheet 66*a* and the two piezoelectric sheets 66*a*, 66*b* are stacked on each other. Thus, the actuator unit 66 enjoys an advantage that it can be manufactured at low cost. As compared with the manufacturing method employed in the first embodiment, the manufacturing method employed in the second embodiment includes the additional step in which the two piezoelectric sheets 66*a*, 66*b* are stacked on each other. However, since the piezoelectric sheet 66*a* may be formed with through-holes instead of non-through or blind holes, the present manufacturing method can be simplified.

Moreover, the actuator unit 66 does not have the structure, disclosed by the previously-identified Japanese Patent Documents Nos. 2002-59547 and 2002-127420, in which a number of piezoelectric sheets and thin electrode layers are stacked on each other. Therefore, the electrodes 77*a*-77*d* embedded in the upper piezoelectric sheet 66*a* can be isolated from the ink by the lower piezoelectric sheet 66*b* having a sufficiently great thickness. Thus, even if fine cracks may occur to the piezoelectric sheets 66*a*, 66*b*, the actuator unit 66 does not suffer the disorder that ink leaks and short circuit occurs between electrodes next to each other. Therefore, the actuator unit 66 enjoys a high durability. In addition, the actuator unit 66 enjoys the same advantages as those of the actuator unit 6 as the first embodiment.

In the second embodiment, the axial lengths of the electrodes 77*a*-77*d* are equal to the thickness of the piezoelectric sheet 66*a*. However, the axial lengths of the electrodes 77*a*-77*d* may be made shorter than the thickness of the sheet 66*a*, without introducing any disadvantages.

Third Embodiment

Figure 7:
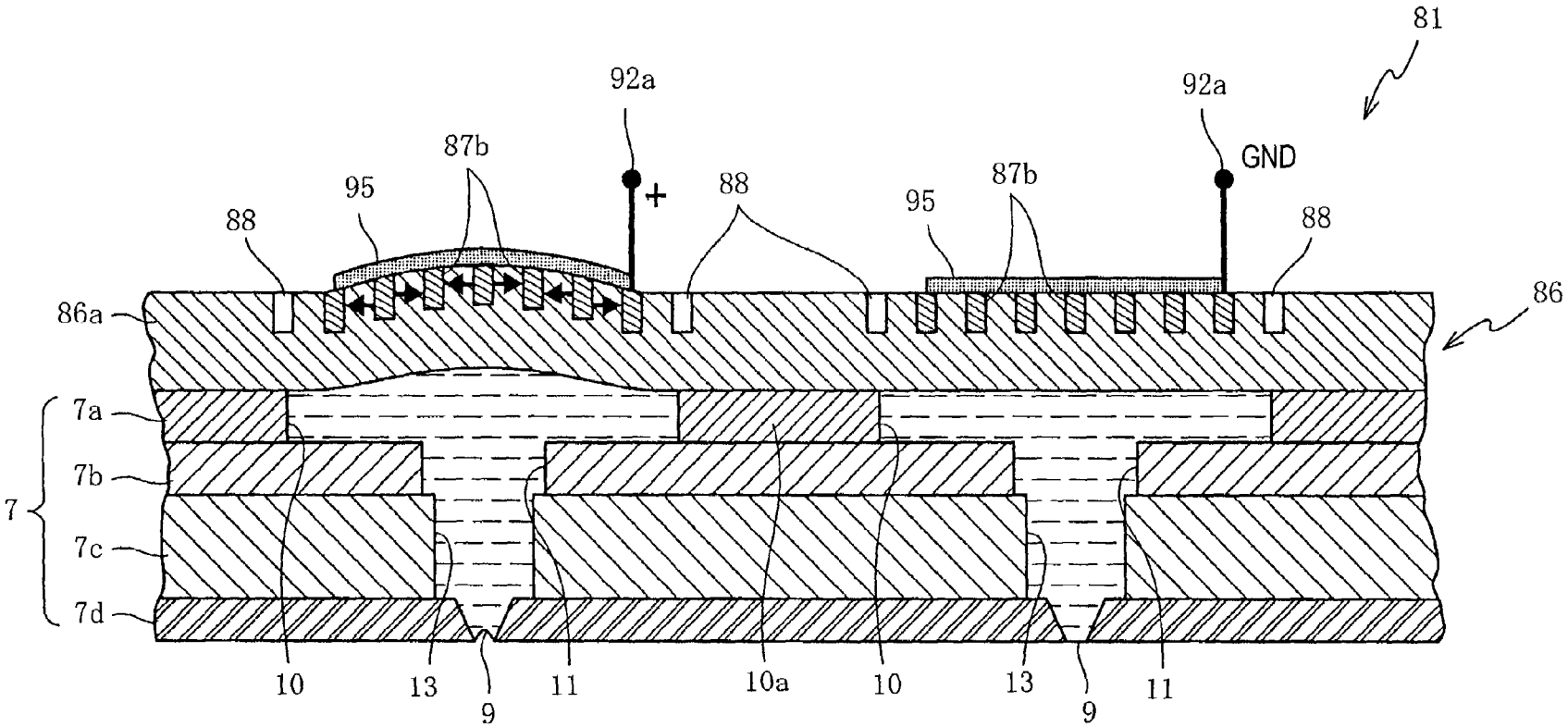
FIG. 7 is a longitudinal cross-sectional view corresponding to FIG. 1 and showing an essential portion of another ink jet printer head including another actuator unit as a third embodiment of the pressure producing apparatus.

FIG. 7 shows a piezoelectric-type ink jet printer head 81 including an actuator unit 86 as a third embodiment of a pressure producing apparatus according to the present invention. However, according to the present invention, the printer head 81 may be said as the pressure producing apparatus. The same reference numerals as used in the first embodiment shown in FIGS. 1 through 3 are used to designate the corresponding elements of the third embodiment, and the description of those elements is omitted. In FIG. 7, the piezoelectric printer head 81 includes a supply-passage unit 7 having a substantially rectangular parallelepiped shape, and the actuator unit 86 having substantially the same shape as that of the supply-passage unit 7 and stacked on the same 7. The actuator unit 86 is equipped with a flexible flat cable or a flexible printed circuit (FPC), not shown, that is connected to an external electric circuit. The printer head 81 outputs ink downward from nozzles 9 opening in a lower surface of the supply-passage unit 7. Since the supply-passage unit 7 employed in the third embodiment is identical with the supply-passage unit 7 employed in the first embodiment, the description of the unit 7 is omitted.

As shown in FIG. 7, in the printer head 81, the actuator unit 86 is driven, via the FPC, by a drive pulse signal that is produced by a drive circuit, not shown. The drive pulse signal selectively takes a ground potential or a certain positive potential. The actuator unit 86 is stacked on the supply-passage unit 7 that defines an ink-supply passage through which the ink is supplied to the nozzles 9. The actuator unit 86 and the supply-passage unit 7 are adhered to each other using an epoxy-type thermosetting adhesive. The actuator unit 86 has terminals 91*a*, 92*a*, 91*b*, 92*b*, 91*c*, 92*c*, 91*d* (only the terminals 92*a* are shown in FIG. 7 and all the terminals are shown in FIG. 8) that are connected to corresponding terminals of the FPC.

Figure 8:
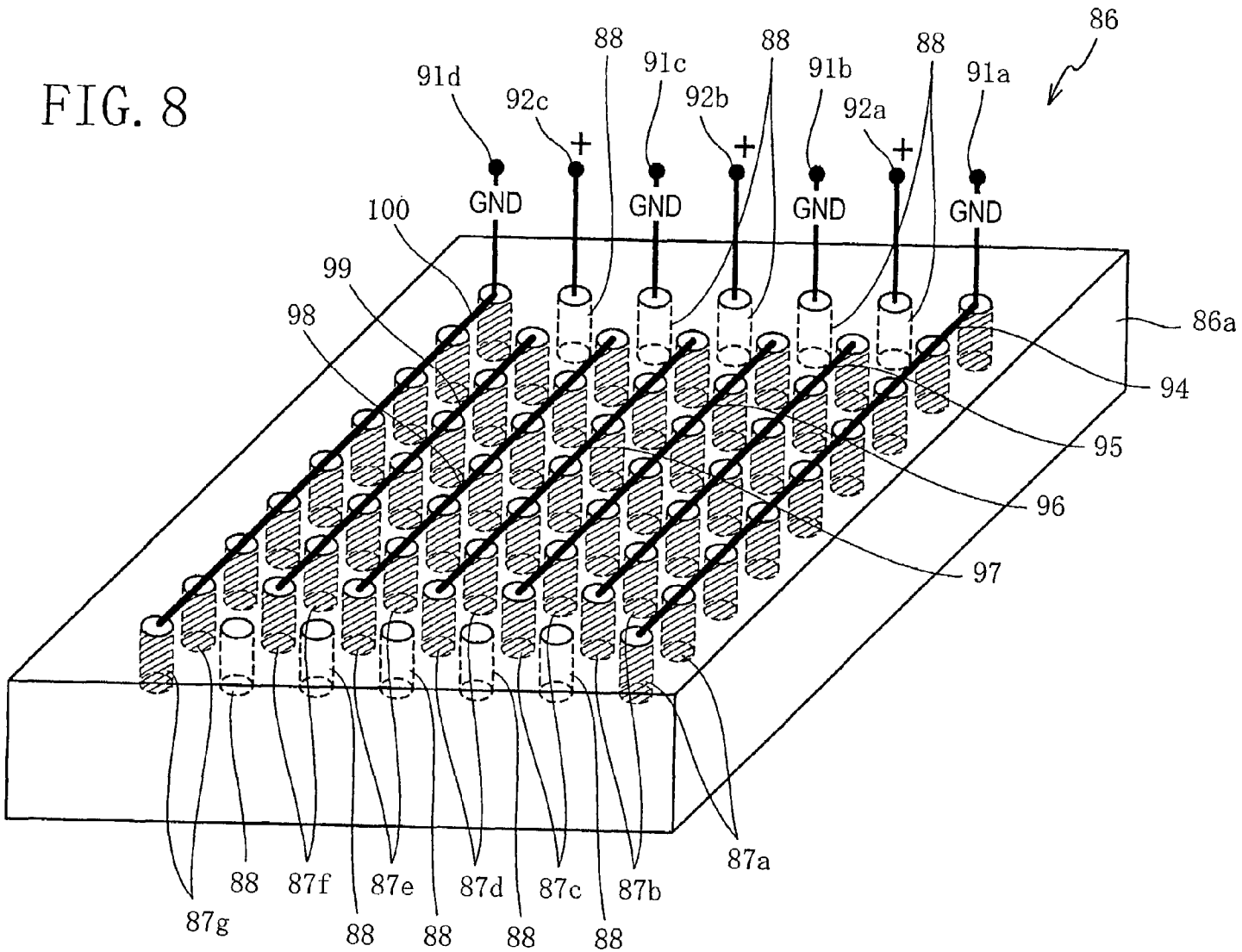
FIG. 8 is an enlarged perspective view of the actuator unit shown in FIG. 7.

As shown in FIG. 8, the actuator unit 86 includes a single piezoelectric ceramic sheet 86*a* that is formed of a ceramic material, i.e., lead zirconate titanate (PZT). Seven groups of cylindrical electrodes 87*a*, 87*b*, 87*c*, 87*d*, 87*e*, 87*f*, 87*g* are embedded in the piezoelectric sheet 86*a*, such that respective axial directions of the electrodes 87*a*-87*g* are parallel to a direction of thickness of the sheet 86*a*. An axial length of each of the electrodes 87*a*-87*g* is somewhat shorter than half the thickness of the piezoelectric sheet 86*a*, and one of axially opposite end surfaces of the each electrode 87*a*-87*g* is exposed in an upper surface of the sheet 86*a* that is opposite to the supply-passage unit 7, so that the each electrode 87*a*-87*g* does not penetrate through the sheet 86*a*. Thus, the electrodes 87*a*-87*g* are located locally in only an upper portion of the piezoelectric sheet 86*a*, and extend in the direction of thickness of the same 86*a* without penetrating the same 86*a*. The upper portion of the piezoelectric sheet 86*a* has a thickness equal to the axial lengths of the electrodes 87*a*-87*g*.

The seven groups of electrodes 87*a*-87*g* are arranged along seven straight lines, respectively, such that the electrodes are equidistant from each other on each of the straight lines. The seven straight lines are parallel to each other and are equidistant from each other. Thus, the electrodes 87*a*-87*g* define a matrix. The actuator unit 86 and the supply-passage unit 7 are adhered to each other such that a limited portion of the upper portion of the piezoelectric sheet 86*a* in which the electrodes 87*a*-87*g* are embedded corresponds to a pressure chamber 10 of the supply-passage unit 7. Thus, all the electrodes 87*a*-87*g* are substantially uniformly distributed in a limited portion of the actuator unit 86 that corresponds to the pressure chamber 10 of the supply-passage unit 7.

The above-indicated limited portion of the upper portion of the piezoelectric sheet 86*a* where the seven groups of electrodes 87*a*-87*g* are provided, provides an active portion in which a first linear portion located between the first group of electrodes 87*a* and the second group of electrodes 87*b* is polarized in a first direction from the electrodes 87*b* toward the electrodes 87*a*; a second linear portion located between the second group of electrodes 87*b* and the third group of electrodes 87*c* is polarized in a second direction from the electrodes 87*b* toward the electrodes 87*c*; a third linear portion located between the third group of electrodes 87*c* and the fourth group of electrodes 87*d* is polarized in a third direction from the electrodes 87*d* toward the electrodes 87*c*; a fourth linear portion located between the fourth group of electrodes 87*d* and the fifth group of electrodes 87*e* is polarized in a fourth direction from the electrodes 87*d* toward the electrodes 87*e*; a fifth linear portion located between the fifth group of electrodes 87*e* and the sixth group of electrodes 87*f* is polarized in a fifth direction from the electrodes 87*f* toward the electrodes 87*e*; and a sixth linear portion located between the sixth group of electrodes 87*f* and the seventh group of electrodes 87*g* is polarized in a sixth direction from the electrodes 87*f* toward the electrodes 87*g*. The first to sixth directions are all parallel to a surface direction parallel to the upper surface of the piezoelectric sheet 86*a*, and are perpendicular to the first to seventh straight lines, respectively. Thus, the respective polarization directions of the first to sixth linear portions of the active portion are alternately changed with each other with respect to a direction perpendicular to the seven straight lines.

The first group of electrodes 87*a* are connected to a terminal 91*a* that is always kept at a ground potential, via a straight metallic wiring 94 provided along the first straight line along which the electrodes 87*a* are arranged. The second group of electrodes 87*b* are connected to a terminal 92*a* that is supplied with a drive pulse signal that selectively takes the ground potential or a certain positive potential, via a straight metallic wiring 95 provided along the second straight line along which the electrodes 87*b* are arranged. The third group of electrodes 87*c* are connected to a terminal 91*b* that is always kept at the ground potential, via a straight metallic wiring 96 provided along the third straight line along which the electrodes 87*c* are arranged. The fourth group of electrodes 87*d* are connected to a terminal 92*b* that is supplied with the drive pulse signal that selectively takes the ground potential or the positive potential, via a straight metallic wiring 97 provided along the fourth straight line along which the electrodes 87*d* are arranged. The fifth group of electrodes 87*e* are connected to a terminal 91*c* that is always kept at the ground potential, via a straight metallic wiring 98 provided along the fifth straight line along which the electrodes 87*e* are arranged. The sixth group of electrodes 87*f* are connected to a terminal 92*c* that is supplied with the drive pulse signal that selectively takes the ground potential or the positive potential, via a straight metallic wiring 99 provided along the sixth straight line along which the electrodes 87*f* are arranged. The seventh group of electrodes 87*g* are connected to a terminal 91*d* that is always kept at the ground potential, via a straight metallic wiring 100 provided along the seventh straight line along which the electrodes 87*g* are arranged.

Thus, the common drive pulse signal is applied to the terminals 92*a*, 92*b*, 92*c*. That is, in the present embodiment, the respective electric potentials of the electrodes 87*b*, 87*d*, 87*f* are always equal to each other, and the respective electric potentials of the electrodes 87*a*, 87*c*, 87*e*, 87*g* are always equal to each other, i.e., always equal to the ground potential. Therefore, the seven groups of electrodes 87*a*, 87*b*, 87*c*, 87*d*, 87*e*, 87*f*, 87*g* can be classified into first electrodes consisting of the electrodes 87*b*, 87*d*, 87*f* and second electrodes consisting of the electrodes 87*a*, 87*c*, 87*e*, 87*g*.

As can be understood from the above description, when the first electrodes 87*b*, 87*d*, 87*f* take the ground potential, no electric field is produced in the linear portion located between each pair of next groups of electrodes that are next to each other in the direction perpendicular to the straight lines, i.e., between the electrodes 87*a* and the electrodes 87*b*, between the electrodes 87*b* and the electrodes 87*c*, between the electrodes 87*c* and the electrodes 87*d*, between the electrodes 87*d* and the electrodes 87*e*, between the electrodes 87*e* and the electrodes 87*f*, or between the electrodes 87*f* and the electrodes 87*g*. On the other hand, when the first electrodes 87*b*, 87*d*, 87*f* take the positive potential, an electric field is produced in the liner portion located between each pair of next groups of electrodes.

Respective directions of the respective electric fields produced in the above-described six linear portions of the active portion of the piezoelectric sheet 86*a* are the same as the respective polarization directions of the six linear portions of the active portion. As a result, the six linear portions of the active portion of the piezoelectric sheet 86*a* that are sandwiched by the seven groups of electrodes 87*a*-87*g* are caused, because of piezoelectric effect, to elongate in the surface direction. The piezoelectric sheet 86*a* includes, in addition to the upper portion thereof, a lower portion which is adjacent to the upper portion in the direction of thickness of the sheet 86*a* and in which no electrodes 87*a*-87*g* are provided. When the electric fields are applied to the active portion of the upper portion, no electric fields are applied to the lower portion and accordingly no forces are produced to elongate the lower portion in the surface direction. As a result, a difference is produced between an amount of elongation in the surface direction of the upper portion and an amount of elongation in the surface direction of the lower portion, and the lower portion resists the elongation of the upper portion in the surface direction. Thus, the actuator unit 86 is operated in a manner similar to the manner in which the unimorph-type actuator unit disclosed by the previously-indicated Japanese Patent Document No. 6-316070 is operated. More specifically explained, the piezoelectric sheet 86*a* is curved in the direction of thickness thereof so that the upper portion thereof swells upward. At the same time, a lower surface of the sheet 86*a* that contacts the ink accommodated in the pressure chamber 10 is curved in a direction to cause expansion of the chamber 10. As a result, the ink flows from the manifold passage 15 into the expanded chamber 10, and fills the same 10.

Subsequently, when the electrodes 87*b*, 87*d*, 87*f* take the ground potential, the electric fields are removed, and the piezoelectric sheet 86*a* returns to its initial, flat shape owing to its own elasticity. As a result, the lower surface of the sheet 86*a* returns to its original position, so that the volume of the pressure chamber 10 is decreased. Thus, a pressure is applied to the ink accommodated in the pressure chamber 10, and a droplet of ink is ejected from the nozzle 9 communicating with the chamber 10. The present ink jet printer head 81 can output ink in either the "push-and-shoot" method or the "draw-and-shoot" method.

In addition, as shown in FIG. 7, two cylindrical recesses 88 each having the same shape as that of each of the cylindrical recesses in which the electrodes 87*b* of the second group are formed, are formed on both sides of the second straight line on which the electrodes 87*b* are arranged. Similarly, as shown in FIG. 8, two cylindrical recesses 88 each having the same shape as that of each of the cylindrical recesses in which the electrodes 87*c* of the third group are formed, are formed on both sides of the third straight line on which the electrodes 87*c* are arranged; two cylindrical recesses 88 each having the same shape as that of each of the cylindrical recesses in which the electrodes 87*d* of the fourth group are formed, are formed on both sides of the fourth straight line on which the electrodes 87*d* are arranged; two cylindrical recesses 88 each having the same shape as that of each of the cylindrical recesses in which the electrodes 87*e* of the fifth group are formed, are formed on both sides of the fifth straight line on which the electrodes 87*e* are arranged; and two cylindrical recesses 88 each having the same shape as that of each of the cylindrical recesses in which the electrodes 87*f* of the sixth group are formed, are formed on both sides of the sixth straight line on which the electrodes 87*f* are arranged. Each of the two recesses 88 corresponding to the second group of electrodes 77*b* is distant from a corresponding one of the two outermost electrodes of the electrodes 87*b*, by a distance equal to the regular distance at which the electrodes 87*b* arranged on the second straight line are equidistant from each other. Similarly, each of the two recesses 88 corresponding to the third group of electrodes 77*c* is distant from a corresponding one of the two outermost electrodes of the electrodes 87*c*, by a distance equal to the regular distance at which the electrodes 87*c* arranged on the third straight line are equidistant from each other; each of the two recesses 88 corresponding to the fourth group of electrodes 77*d* is distant from a corresponding one of the two outermost electrodes of the electrodes 87*d*, by a distance equal to the regular distance at which the electrodes 87*d* arranged on the fourth straight line are equidistant from each other; each of the two recesses 88 corresponding to the fifth group of electrodes 77*e* is distant from a corresponding one of the two outermost electrodes of the electrodes 87*e*, by a distance equal to the regular distance at which the electrodes 87*e* arranged on the fifth straight line are equidistant from each other; and each of the two recesses 88 corresponding to the sixth group of electrodes 77*f* is distant from a corresponding one of the two outermost electrodes of the electrodes 87*f*, by a distance equal to the regular distance at which the electrodes 87*f* arranged on the sixth straight line are equidistant from each other. Thus, the active portion of the piezoelectric sheet 86*a* is partly and discontinuously surrounded by the recesses 88 in a plane defined by the sheet 86*a*.

Next, there will be briefly described a method of manufacturing the ink jet printer head 81 as described above, by reference to FIGS. 7 and 8. The printer head 81 is manufactured by first producing components, such as the supply-passage unit 7 and the actuator unit 86, separately from each other, and then assembling those components into the head 81.

Since the supply-passage unit 7 is produced in the same steps as those employed in the first embodiment, the description of those steps is omitted. The actuator unit 86 is produced as follows: First, a single green sheet is formed of a piezoelectric ceramic material, and a press or a laser is used to form, in each of respective portions of the green sheet that correspond to the pressure chambers 10, seven groups of cylindrical recesses to be used to receive electrodes, and five pairs of cylindrical recesses 88. Pressing is advantageous because it can be carried out simultaneously when the green sheet is formed into a prescribed shape corresponding to the actuator unit 86.

Subsequently, an electrically conducting material in the form of a paste is cast in each of the cylindrical recesses of the seven groups and, then, the piezoelectric-ceramic green sheet is degreased, and is fired at an appropriate temperature, as other sorts of ceramic green sheets are routinely done. Thus, the piezoelectric-ceramic sheet 86*a* having the electrodes 87*a*-87*g* formed in the respective cylindrical recesses and additionally having the ten recesses 88 formed on both sides of the second to sixth straight lines is obtained. In addition, printing or vapor deposition is used to connect the seven metallic wirings 94-100 to the first to seventh groups of electrodes 87*a*-87*g*, respectively. Thus, the actuator unit 86 is obtained. The dimensions of the piezoelectric-ceramic green sheet is designed in view of amounts of shrinkage thereof due to firing.

Then, the supply-passage unit 7 and the actuator unit 86 are adhered to each other with a thermosetting adhesive such that the respective positions of the active portions of the actuator unit 86 are aligned with the respective positions of the corresponding pressure chambers 10 of the supply-passage unit 7. Subsequently, the actuator unit 86 and an FPC are bonded to each other with solder such that the terminals of the actuator unit 86 and the corresponding terminals of the FPC are superposed on each other.

Then, in a state in which the first, third, fifth, and seventh groups of electrodes 87*a*, 87*c*, 87*e*, 87*g* are kept at a ground potential, a positive high potential is applied to the second, fourth, and sixth groups of electrodes 87*b*, 87*d*, 87*f*, so as to polarize the first to sixth linear portions of the piezoelectric sheet 86*a*, located between the seven groups of electrodes 87*a*-87*g*, in the direction in which the electrodes are opposed to each other, i.e., in the surface direction, and thereby provide an active portion corresponding to each pressure chamber 10. Thus, the ink jet printer head 81 is manufactured.

In the above-described manufacturing method, a laser may be used to form the seven groups of cylindrical recesses and the five pairs of cylindrical recesses in the green sheet, after the green sheet is fired. In addition, the electrodes 87*a*-87*g* may be disposed in the seven groups of recesses, after the green sheet is fired. Moreover, the actuator unit 86 and the FPC may be bonded to each other, after the actuator unit 86 is subjected to the above-described polarization step. In the last case, it is needed to apply the electric potentials to the electrodes 87*a*-87*d*, using an electric circuit other than the FPC.

In the actuator unit 86 as the third embodiment of the pressure producing apparatus, the potential difference between the first electrodes 87*a*, 87*c*, 87*e*, 87*g* and the second electrodes 87*b*, 87*d*, 87*f* all of which are embedded in the piezoelectric sheet 86*a*, can be controlled to switch the piezoelectric sheet 86*a* to either a curved state in which the sheet 86*a* is curved in the direction of thickness thereof, or a non-curved state in which the sheet 86*a* is not curved. Thus, a pressure can be applied to the ink accommodated in a desired one or ones of the pressure chambers 10, so as to output the ink from the desired pressure chamber or chambers 10.

In addition, the present actuator unit 86 can be easily manufactured by employing the simple step in which the electrodes 87*a*-87*g* are embedded in the piezoelectric sheet 86*a*. Thus, the actuator unit 86 enjoys an advantage that it can be manufactured at low cost. Since the five pairs of recesses 88 can be formed simultaneously with the formation of the seven groups of recesses for receiving the electrodes 87*a*-87*g*, the present manufacturing method is not complicated as compared with the manufacturing method employed in the first embodiment. Moreover, the actuator unit 86 does not have the structure, disclosed by the previously-identified Japanese Patent Documents Nos. 2002-59547 and 2002-127420, in which a number of piezoelectric sheets and thin electrode layers are stacked on each other. Therefore, the electrodes 87*a*-87*g* embedded in the upper portion of the piezoelectric sheet 86*a* can be isolated from the ink by the lower portion of the piezoelectric sheet 86*a* having a sufficiently great thickness. Thus, even if fine cracks may occur to the piezoelectric sheet 86*a*, the actuator unit 86 does not suffer the disorder that ink leaks and short circuit occurs between electrodes next to each other. Therefore, the actuator unit 86 enjoys a high durability.

In addition, in the third embodiment, since each of the active portions of the piezoelectric sheet 86*a* is partly and discontinuously surrounded by the recesses 88 in the plane defined by the sheet 86*a*, the deformation of one active portion of the sheet 86*a* can be prevented from propagating to another or other active portions next to the one active portion. Thus, the outputting of ink from the nozzle 9 next to the nozzle 9 that is outputting ink, is effectively prevented from being adversely affected by the latter nozzle 9. That is, the cross-talk between the nozzles 9 can be effectively reduced. In addition, the actuator unit 86 enjoys the same advantages as those of the actuator unit 6 as the first embodiment.

In the third embodiment, the axial lengths of the recesses 88 are equal to those of the electrodes 87*a*-87*g*. However, the axial lengths of the recesses 88 may be made longer than those of the electrodes 87*a*-87*g* for the purpose of improving the effect of reducing the cross-talk between the nozzles 9. In addition, the cylindrical recesses 88 which discontinuously surround the active portion of the piezoelectric sheet 86*a* may be replaced with an annular recess or groove which continuously surround the active portion, for the purpose of further improving the effect of reducing the cross-talk between the nozzles 9. In the first embodiment shown in FIG. 3, the cylindrical recesses 88 or the annular recess or groove may be provided outside the fourth group of electrodes 17*d*; and in the second embodiment shown in FIG. 5, the cylindrical recesses 88 or the annular recess or groove may be provided outside the fourth group of electrodes 77*d* in the upper piezoelectric-ceramic sheet 86*a*.

Figure 9:
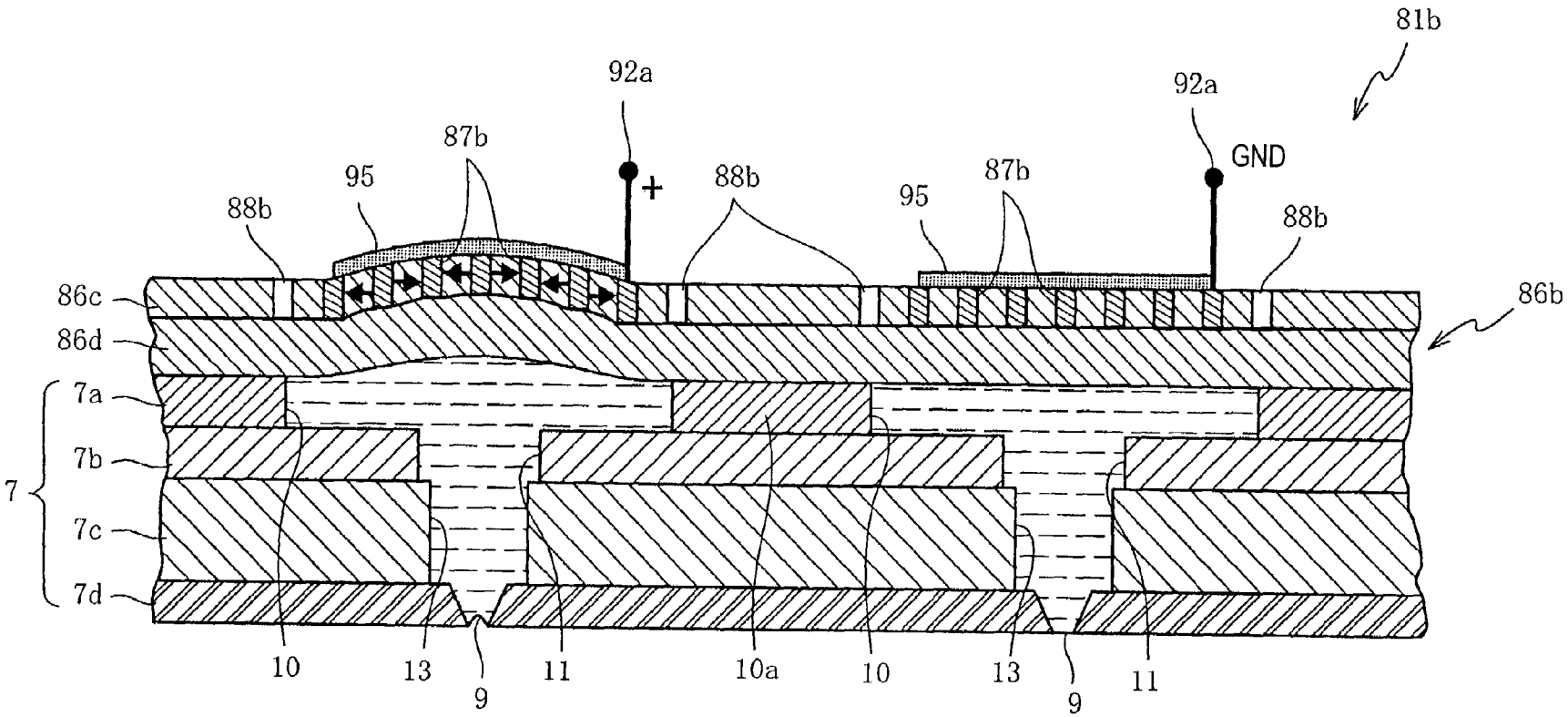
FIG. 9 is a longitudinal cross-sectional view corresponding to FIG. 1 and showing an essential portion of a modified form of the ink jet printer head shown in FIG. 7.
Figure 10:
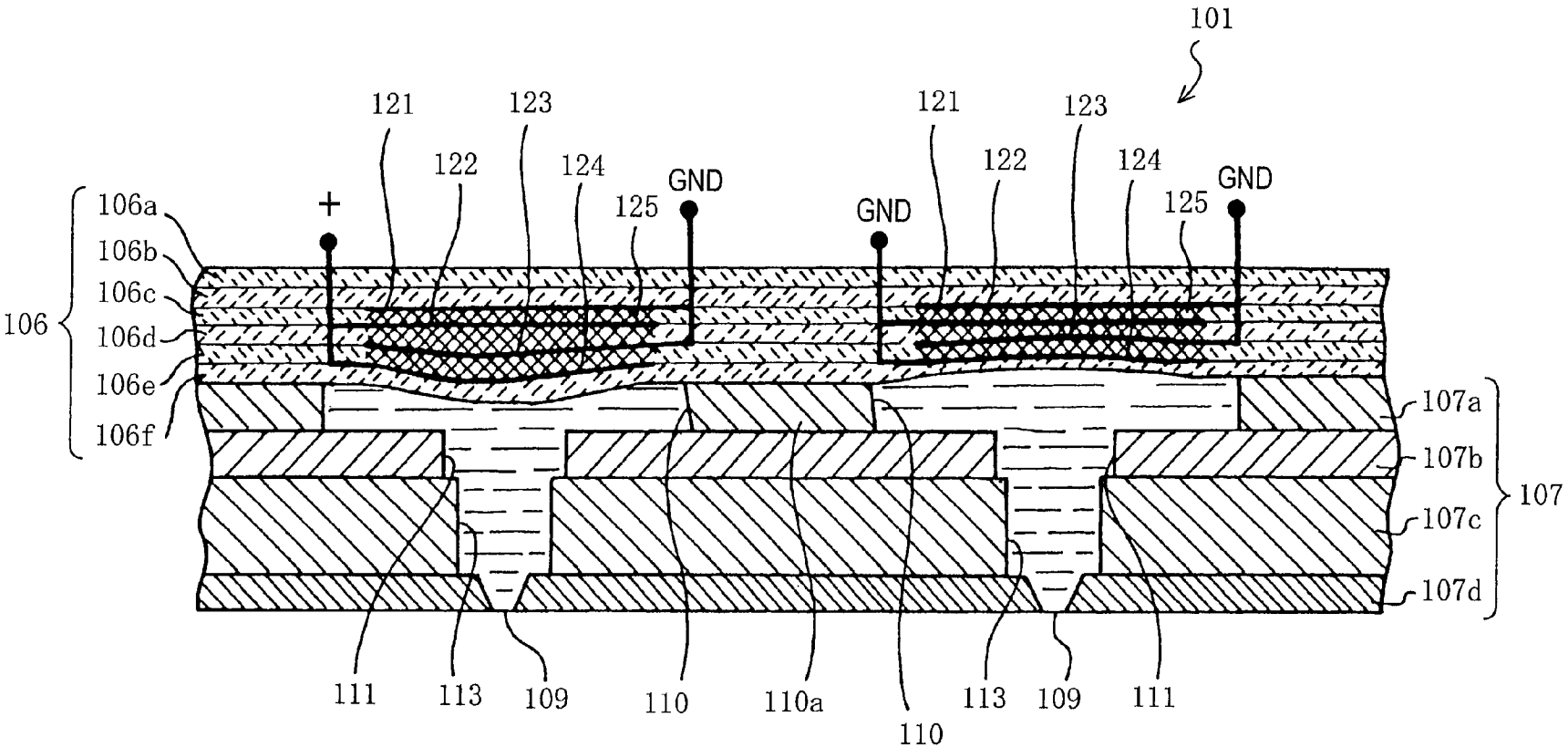
FIG. 10 is a longitudinal cross-sectional view of a relevant portion of a conventional ink jet printer head.

FIG. 9 shows a modified form 81*b* of the ink jet printer head 81 shown in FIG. 7. This modified printer head 81*b* differs from the printer head 81, in that an actuator unit 86*b* of the modified printer head 81*b* includes an upper piezoelectric ceramic sheet 86*c* and a lower piezoelectric ceramic sheet 86*d* and that the upper piezoelectric ceramic sheet 86*c* has five pairs of cylindrical through-holes 88*b* in place of the five pairs of cylindrical recesses 88 of the actuator unit 86 of the printer head 81. The through-holes 88*b* can be more easily formed than the recesses 88, i.e., non-through holes.

While the present invention has been described in detail in its preferred embodiments, it is to be understood that the present invention is not limited to the details of those embodiments and may be otherwise embodied.

For example, the lines along which the electrodes 17, 47, 77, 87 are arranged are not limited to the concentric circles or the straight lines. For example, the electrodes may be arranged along a plurality of ellipses that are concentric with each other, or a plurality of rectangles that are concentric with each other. In addition, in each case, the circles, the ellipses, or the rectangles are not limited to the concentric circles, the concentric ellipses, or the concentric rectangles, respectively. In each case, it is not required that the electrodes be arranged at a regular interval along a line.

In each of the first and third embodiments, the actuator unit 6, 36, 86 consists of the single piezoelectric sheet 6*a*, 86*a*; and in the second embodiment, the actuator unit 66 consists of the two piezoelectric sheets 66*a*, 66*b*. However, it is possible that an actuator unit consist of three or more piezoelectric sheets. In the last case, the electrodes may be provided in at least the outermost one of the piezoelectric sheets, without penetrating all of the piezoelectric sheets.

The electrodes 17, 47, 77, 87 that are provided in the piezoelectric sheet 6*a*, 36*a*, 66*a*, 86*a* may take any shape or size, or may be distributed in any manner. For example, in each of the illustrated embodiments, the considerably small-size electrodes 17, 47, 77, 87 are appropriately distributed in the piezoelectric sheet 6*a*, 36*a*, 66*a*, 86*a*. However, it is possible to employ two large-size belt-like electrodes and provide the two electrodes such that the two electrodes are opposed to each other. In addition, in each of the illustrated embodiments, the electrodes 17, 47, 77, 87 are located locally in the upper portion of the actuator unit 6, 36, 66, 86, such that the respective one ends of the electrodes are exposed. However, the electrodes may be completely embedded in the actuator unit such that no portions of the electrodes are exposed. In addition, the electrodes may be located locally in the lower portion of the actuator unit that has the lower surface of the unit and partly defines the pressure chambers 10. In the last case, when electric fields are applied to the actuator unit, the respective volumes of the pressure chambers are decreased.

In addition, in each of the illustrated embodiments, the respective portions of each active portion of the piezoelectric sheet 6*a*, 36*a*, 66*a*, 86*a* are polarized in advance in the same directions as the directions in which the electric fields are to be applied to those portions of the each active portion. However, the directions of polarization may be directions intersecting the directions of application of electric fields. For example, regarding the first embodiment shown in FIG. 1, the first annular portion located between the first group of electrode 17*a* and the second group of electrodes 17*b*, the second annular portion located between the second group of electrodes 17*b* and the third group of electrodes 17*c*, and the third annular portion located between the third group of electrodes 17*c* and the fourth group of electrodes 17*d* may be polarized in the direction of thickness of the piezoelectric sheet 6*a*, such that the respective polarization directions of the first and third annular portions are opposite to the polarization direction of the second annular portion. In this case, the first to third annular portions of the active portion show a shear-mode deformation in which the active portion as a whole is deformed to take a conical shape whose vertex is defined by the central electrode 17*a*. In this case, however, the electrodes 17*a*-17*d* cannot be used to polarize the first to third annular portions of the active portion. Therefore, before the FPC is bonded to the piezoelectric sheet 6*a*, other means than the electrodes is used to polarize the active portion. In addition, in each of the illustrated embodiments, the positive potential and the ground potential may be applied to the first and second electrodes, respectively, in a manner different from the manner described in connection with the each embodiment. Moreover, a positive potential and a negative potential may be applied to the first and second electrodes, respectively, or a negative potential and a ground potential may be applied to the first and second electrodes, respectively.

The present invention is also applicable to a liquid drop ejecting apparatus that has a construction similar to that of the ink jet printer head, described above in connection with each of the illustrated embodiments, and that outputs an electrically conductive paste to print a very fine electric circuit pattern, or outputs an organic luminescent material to produce a highly precise display device such as an organic electro-luminescent display (OELD). In addition, the liquid-drop ejecting apparatus having the construction similar to that of the ink jet printer head, can be widely used to form fine dots on a recording medium.

As is apparent from the foregoing description of the present invention, the pressure producing apparatus can be easily manufactured in the simple step in which the first and second electrodes are provided in the sheet member such that those electrodes do not penetrate through the thickness of the sheet member, or in the simple steps in which the first and second electrodes are provided in the first sheet member and the first sheet member and the second sheet member are stacked on each other. Thus, the pressure producing apparatus can be manufactured at low cost. In addition, the pressure producing apparatus does not have the structure in which a number of sheets and a number of electrodes are stacked on each other. Therefore, even if fine cracks may occur to the sheet member, or the first or second sheet member, the producing apparatus does not suffer the disorder that ink leaks and short circuit occurs between electrodes next to each other. Therefore, the producing apparatus enjoys a high durability.

It is to be understood that the present invention may be embodied with various changes, modifications and improvements that may occur to a person skilled in the art, without departing from the spirit and scope of the invention defined in the appended claims.

What is claimed is:

1. A pressure producing apparatus, comprising:

a sheet member which is formed of a piezoelectric material;

a plurality of first electrodes which are embedded in a first area of at least one of a first portion and a second portion of the sheet member, such that the first electrodes are separate from each other in the first area, the first portion and the second portion being opposite to each other in a direction of thickness of the sheet member;

a plurality of second electrodes which are embedded in a second area of said at least one of the first and second portions of the sheet member, such that the second electrodes are separate from each other in the second area, the second area being adjacent to the first area in a surface direction parallel to a first surface of the first portion and a second surface of the second portion that are opposite to each other in the direction of thickness of the sheet member; and a liquid-chamber defining member which cooperates with one of the first and second surfaces of the sheet member to define a liquid chamber in which a liquid is accommodated, wherein an electric field is applied between the first electrodes and the second electrodes, so as to produce a difference between an amount of elongation in the surface direction of the first portion of the sheet member and an amount of elongation in the surface direction of the second portion of the sheet member and thereby curve the sheet member in the direction of thickness thereof and change a pressure of the liquid accommodated in the liquid chamber.

2. The pressure producing apparatus according to claim 1, wherein the first electrodes and the second electrodes are embedded in said at least one of the first and second portions of the sheet member, such that the first electrodes and the second electrodes extend from an other of the first and second surfaces of the first and second portions of the sheet member in the direction of thickness thereof.

3. The pressure producing apparatus according to claim 1, wherein a plurality of portions of said at least one of the first and second portions of the sheet member that are located between the plurality of first electrodes and the plurality of second electrodes are polarized in the surface direction so as to provide a plurality of active portions, and wherein when the electric field is applied to each of the active portions of the sheet member in a same direction as the direction of polarization of said each active portion, the sheet member is curved in the direction of thickness thereof because of the difference between the amount of elongation in the surface direction of the first portion of the sheet member and the amount of elongation in the surface direction of the second portion of the sheet member.

4. The pressure producing apparatus according to claim 1, wherein the first and second electrodes are embedded in a limited portion of said at least one of the first and second portions of the sheet member that is limited in the surface direction.

5. The pressure producing apparatus according to claim 4, wherein the sheet member has, in an other of the first and second surfaces thereof, a plurality of recesses which cooperate with each other to at least partly surround the limited portion of said at least one of the first and second portions in which the first and second electrodes are provided.

6. The pressure producing apparatus according to claim 1, wherein the first electrodes comprise a plurality of groups of first electrodes and the second electrodes comprise a plurality of groups of said second electrodes, wherein the liquid-chamber defining member includes at least one partition wall which cooperates with said one of the first and second surfaces of the sheet member to define a plurality of said liquid chambers in each of which the liquid is accommodated, and wherein the plurality of groups of first electrodes and the plurality of groups of second electrodes are provided in a plurality of limited portions of said at least one of the first and second portions of the sheet member, respectively, that are aligned with the plurality of liquid chambers, respectively.

7. The pressure producing apparatus according to claim 1, wherein the first portion of the sheet member comprises a first sheet member and the first electrodes are embedded in the first sheet member, wherein the second electrodes are embedded in the first sheet member, and wherein the second portion of the sheet member comprises a second sheet member which is stacked on the first sheet member and resists elongation of the first sheet member in the surface direction that occurs when the electric field is applied, in the surface direction, to a plurality of portions of the first sheet member that are located between the first electrodes and the second electrodes.

8. The pressure producing apparatus according to claim 7, wherein the first electrodes and the second electrodes are embedded in the first sheet member such that the first electrodes and the second electrodes extend from the first surface of the first sheet member in a direction of thickness thereof.

9. The pressure producing apparatus according to claim 8, wherein the first electrodes and the second electrodes extend through the thickness of the first sheet member.

10. The pressure producing apparatus according to claim 7, wherein the first electrodes and the second electrodes are embedded in a limited portion of the first sheet member that is limited in the surface direction.

11. The pressure producing apparatus according to claim 10, wherein the first sheet member has, in the first surface thereof opposite to the second sheet member, a plurality of recesses which at least partly surround the limited portion of the first sheet member in which the first and second electrodes are embedded.

12. The pressure producing apparatus according to claim 11, wherein the plurality of recesses comprise a plurality of through-holes which are formed through the thickness of the first sheet member.

13. The pressure producing apparatus according to claim 7, wherein the liquid-chamber defining member cooperates with the second surface of the second sheet member that is opposite to the first sheet member to define the liquid chamber in which the liquid is accommodated, and wherein the apparatus changes the pressure of the liquid accommodated in the liquid chamber.

14. The pressure producing apparatus according to claim 13, wherein the first electrodes comprise a plurality of groups of first electrodes and the second electrodes comprise a plurality of groups of second electrodes, wherein the liquid-chamber defining member includes at least one partition wall which cooperates with the second surface of the second sheet member to define a plurality of said liquid chambers in each of which the liquid is accommodated, and wherein the plurality of groups of first electrodes and the plurality of groups of second electrodes are provided in a plurality of limited portions of the first sheet member, respectively, that are aligned with the plurality of liquid chambers, respectively.

15. The pressure producing apparatus according to claim 1, wherein the liquid chamber of the liquid-chamber defining member accommodates an ink as the liquid, and wherein the apparatus further comprises a nozzle-defining member which defines a nozzle which communicates with the liquid chamber and ejects a droplet of the ink when the sheet member is curved in the direction of thickness thereof to change the pressure of the ink accommodated in the liquid chamber.

16. The pressure producing apparatus accordingly to claim 1, wherein the first portion and the second portion of the sheet member comprises a first sheet member and a second sheet member, respectively, which are stacked on each other, wherein the first electrodes are embedded in at least one of the first sheet member and the second sheet member, wherein the second electrodes are embedded in said at least one of the first sheet member and the second sheet member, wherein the liquid-chamber defining member cooperates with one of the first and second surfaces of the first and second sheet members to define the liquid chamber in which the liquid is accommodated, and wherein the electric field is applied between the one first electrodes and the second electrodes, so as to produce a difference between an amount of elongation in the surface direction of the first sheet member and an amount of elongation in the surface direction of the second sheet member and thereby curve the first and second sheet members in the respective directions of thickness thereof and change the pressure of the liquid accommodated in the liquid chamber.

17. The pressure producing apparatus according to claim 16, wherein the liquid chamber of the liquid-chamber defining member accommodates an ink as the liquid, and wherein the apparatus further comprises a nozzle-defining member which defines a nozzle which communicates with the liquid chamber and ejects a droplet of the ink when the first and second sheet members are curved in the directions of thickness thereof to change the pressure of the ink accommodated in the liquid chamber.

18. The pressure producing apparatus according to claim 1, wherein the plurality of first electrodes comprise a plurality of groups of first electrodes each group of which include at least two first electrodes and are embedded in a corresponding one of a plurality of said first areas of said at least one of the first portion and the second portion of the sheet member, such that said at least two first electrodes are separate from each other in said corresponding first area, and the plurality of second electrodes comprise a plurality of groups of second electrodes each group of which includes at least two second electrodes and are embedded in a corresponding one of a plurality of said second areas of said at least one of the first and second portions of the sheet member, such that said at least two second electrodes are separate from each other in said corresponding second area, and wherein the plurality of first areas and the plurality of second areas are arranged alternately with each other in the surface direction.

19. The pressure producing apparatus according to claim 18, wherein each of the plurality of first areas and the plurality of second areas has an elongate shape.

20. The pressure producing apparatus according to claim 18, wherein each of the plurality of first areas and the plurality of second areas has an annular shape.

21. The pressure producing apparatus according to claim 1, wherein the first electrodes are arranged along a first line in the first area and the second electrodes are arranged, in the second area, along a second line which is separate from, and opposed to, the first line in the surface direction.

22. The pressure producing apparatus according to claim 21, wherein the first electrodes comprise a plurality of groups of first electrodes and the second electrodes comprise a plurality of groups of-second electrodes, wherein the plurality of groups of first electrodes are arranged along a plurality of concentric first circles as a plurality of said first lines, respectively, and the plurality of groups of second electrodes are arranged along a plurality of concentric second circles as a plurality of said second lines, respectively, and wherein the first and second circles are concentric with each other and the groups of first electrodes and the groups of second electrodes are alternate with each other in a radial direction of the concentric first and second circles.

23. The pressure producing apparatus according to claim 21, wherein the first electrodes comprise a plurality of groups of said first electrodes and the second electrodes comprise a plurality of groups of second electrodes, wherein the plurality of groups of first electrodes are arranged along a plurality of first straight lines as a plurality of said first lines, respectively, and the plurality of groups of second electrodes are arranged along a plurality of second straight lines as a plurality of said second lines, respectively, and wherein the groups of first electrodes and the groups of second electrodes are alternate with each other in a direction intersecting the first and second straight lines.

24. The pressure producing apparatus according to claim 1, wherein each of the first and second electrodes has a columnar shape having a substantially constant cross-section area in a direction parallel to an axis line thereof, and is embedded in said at least one of the first and second portions of the sheet member such that the axis line of said each electrode extends substantially parallel to the direction of thickness of the sheet member.

25. The pressure producing apparatus according to claim 1, further comprising:

a first wiring which electrically connects the first electrodes to each other and which is provided outside the sheet member; and a second wiring which electrically connects the second electrodes to each other and which is provided outside the sheet member.

26. The pressure producing apparatus according to claim 25, wherein each of the first wiring and the second wiring is provided on an other of the first surface and the second surface of the sheet member.

27. The pressure producing apparatus according claim 1, wherein the plurality of first electrodes comprise at least three first electrodes which are embedded in said at least one of the first portion and the second portion of the sheet member, such that said at least three first electrodes are separate from each other and are arranged along a first line, wherein the plurality of second electrodes comprise at least three second electrodes which are embedded in said at least one of the first and second portions of the sheet member, such that said at least three second electrodes are separate from each other and are arranged along a second line which is separate from, and opposed to, the first line in the surface direction parallel to the first surface and the second surface of the sheet member, and wherein each of said at least three first electrodes and said at least three second electrodes has a columnar shape having a substantially constant cross-section area in a direction parallel to an axis line thereof, and is embedded in said at least one of the first and second portions of the sheet member such that the axis line of said each electrode extends substantially parallel to the direction of thickness of the sheet member.

28. The pressure producing apparatus according to claim 27, wherein at least six said first electrodes are arranged along at least two said first lines which are separate from each other in the surface direction, such that said at least three first electrodes are arranged along each of said at least two first lines, and at least six said second electrodes are arranged along at least two said second lines which are separate from, and alternate with, said at least two first lines in the surface direction, such that said at least three second electrodes are arranged along each of said at least two second lines; and wherein each of said at least six first electrodes and said at least six second electrodes has the columnar shape.

29. The pressure producing apparatus according to claim 1, wherein the plurality of first electrodes are embedded in said at least one of the first portion and the second portion of the sheet member, such that the first electrodes are separate from each other and are arranged along a plurality of first lines which are separate from each other in the surface direction as a first surface direction parallel to the first surface and the second surface of the sheet member, wherein the plurality of second electrodes are embedded in said at least one of the first and second portions of the sheet member, such that the second electrodes are separate from each other and are arranged along a plurality of second lines which are separate from, and alternate with, the first lines in the first surface direction, wherein the first electrodes are arranged along a plurality of third lines which intersect the first lines and are separate from each other in a second surface direction that is parallel to the first and second surfaces of the sheet member and intersects the first surface direction, and wherein the second electrodes are arranged along at least one fourth line which is separate from, and alternate with, the third lines in the second surface direction.

30. The pressure producing apparatus according to claim 29, wherein the first, second, third, and fourth lines are straight.

31. A pressure producing apparatus comprising:

a sheet member which is formed of a piezoelectric material;

a plurality of first electrodes which are embedded in a first area of one of a first portion and a second portion of the sheet member, such that the first electrodes are separate from each other in the first area, the first portion and the second portion being opposite to each other in a direction of thickness of the sheet member;

a plurality of second electrodes which are embedded in a second area of said one of the first and second portions of the sheet member, such that the second electrodes are separate from each other in the second area, the second area being adjacent to the first area in a surface direction parallel to one of a first surface of the first portion and a second surface of the second portion, the first surface and the second surface being opposite to each other in the direction of thickness of the sheet member, wherein each of the first and second electrodes has a columnar shape having a substantially constant cross-section area in a direction parallel to an axis line thereof, and is embedded in said one of the first and second portions of the sheet member such that the axis line of said each electrode extends substantially parallel to the direction of thickness of the sheet member, and wherein said each of the first and second electrodes has a cylindrical shape as said columnar shape.

32. A pressure producing apparatus comprising:

a sheet member which is formed of a piezoelectric material and which includes a first portion and a second portion that are opposite to each other in a direction of thickness of the sheet member and have a first surface and a second surface, respectively, that are opposite to each other in the direction of thickness of the sheet member;

a plurality of first electrodes which are embedded in one of the first portion and the second portion of the sheet member, such that the first electrodes are separate from each other and are arranged along a plurality of first lines which are separate from each other in a first surface direction parallel to one of the first surface and the second surface of the sheet member; and a plurality of second electrodes which are embedded in said one of the first and second portions of the sheet member, such that the second electrodes are separate from each other and are arranged along a plurality of second lines which are separate from, and alternate with, the first lines in the first surface direction, wherein the first electrodes are arranged along a plurality of third lines which intersect the first lines and are separate from each other in a second surface direction that is parallel to said one of the first and second surfaces of the sheet member and intersects the first surface direction, wherein the second electrodes are arranged along at least one fourth line which is separate from, and alternate with, the third lines in the second surface direction, and wherein the first and second lines are straight and are angularly separate from eachother, and the third and fourth lines are circular and concentric with each other.

* * * * *